US007028783B2

(12) United States Patent
Celorio-Villasenor

(10) Patent No.: US 7,028,783 B2
(45) Date of Patent: Apr. 18, 2006

(54) AMBIENT-AIR JET BLAST FLAMES CONTAINMENT AND SUPPRESSION SYSTEM

(76) Inventor: Armando Celorio-Villasenor, Cerrada De Fresno 39 - A 201 Col. Jesus Del Monte, Mexico, Mexico D.F. (MX) 05260

( * ) Notice: Subject to any disclaimer, the term of this patent is extended or adjusted under 35 U.S.C. 154(b) by 241 days.

(21) Appl. No.: 10/660,778

(22) Filed: Sep. 12, 2003

(65) Prior Publication Data

US 2005/0077055 A1 Apr. 14, 2005

(51) Int. Cl.
*A62C 2/00* (2006.01)

(52) U.S. Cl. ..... 169/46; 169/47; 169/49; 169/67; 169/68; 169/70; 239/126; 239/290

(58) Field of Classification Search ..... 169/46, 169/47, 48, 49, 67, 68, 70, 69, 5; 239/151, 239/128, 129, 290
See application file for complete search history.

(56) References Cited

U.S. PATENT DOCUMENTS 5,046,564 A * 9/1991 Poulsen ..... 169/47
5,238,071 A * 8/1993 Simpson ..... 169/47

* cited by examiner

*Primary Examiner*—Dinh Q. Nguyen

(57) ABSTRACT

In the fire location, an ambient or atmospheric air mass flow (been a gas mixture of dry air and superheated water vapor) is compressed by a compression package. A hose transports this compressed air mass flow a given distance away up to a flames site, where an arrangement of pipes, elbow accessories, throttle valves, nozzles, and a distribution manifold, conforming together a fire fight boom with a "blast-gun", allow the operator to direct upon the flames, a high speed ambient air jet containing water droplets with a high flame front aerodynamic penetration capability, which brings about the flames blown off and remaining not burned materials combustion inhibition. Such a high speed air jet containing water droplets is generated by the compressed air mass flow expansion in a jacketed convergent-divergent nozzle, whereinto a condensation sock wave is established producing such water droplets from the local ambient air water vapor contents. The air jet proximity to the flames' origin is important, and the operator's movements can be controlled by a wheel, a pneumatic cylinder, supports, and pivoted anchors. To preclude, in this process, the inflammation of surrounding non burning materials and the existence of run-away flame fronts, different aerodynamic flame containment mechanisms are formed by other air jets produced in convergent nozzles air expansions. To allow the low temperatures required and the successful establishment of the condensation shock wave, a cooling air flow insulates, from the hot flame environment, the air flow expansion in the jacketed convergent-divergent nozzle. The aspersion mechanism formed by the air mass flow expansion, is utilized also to deliver different chemical fire fight agents to the flames sites with a high flame front penetration capability.

1 Claim, 14 Drawing Sheets

AMBIENT-AIR JET BLAST FLAMES CONTAINMENT AND SUPPRESSION SYSTEM

BACKGROUND OF THE INVENTION

1. Field of the Invention

The invention herein presented relates to a new fire control system, which utilizes a compressed ambient or atmospheric air mass flow, considered as a gas mixture (dry air and superheated water vapor), as the working agent needed to activate its flames containment and suppression mechanisms, performing also the aspersion of a fire fight agent, generating heat transfer, gas mixture components separation, and gas dynamics processes in a jacketed convergent-divergent nozzle to produce a high speed ambient air jet containing water droplets, which penetrates the flames fronts and blast the flames origin, bringing about such flames blown off.

2. Description of Related Art

Out of control fires, in particular near-city forests fires (wildland-suburban interface) present severe threats to both life and property and the risk for any community is always present. Therefore, a critical need exists for more innovative and more effective fire control methods.

Current active methods used to suppress flames of different kinds, use various procedures: by the combustion inhibition through the wetting and cooling of the flames site using water splashes and jets, or water sprays and mists, such water been obtained from natural reservoirs or man made deposits; by the use of gases such as carbon dioxide; and also, by the use of foams and other chemical additives, but all of them, utilize the direct aspersion of their respective fire fight agent as the only mechanism to execute the flame suppression action, and therefore, in some situations, they present a limited, not continuous, and not always prompt enough supply of any of these agents in the fire location, specially in forest fires.

These methods at present in service for flames suppression, have proved or demonstrated in actual circumstances, not to be as effective as required, in particular in massive widespread intense forest fires (trees and grasslands).

The inventor has found through computational simulations and verified through actual experimental observations, that the thermodynamic state of the superheated water vapor present in different amounts in the ambient or atmospheric air (a gas mixture), can be modified, even in very high temperature surroundings, not only to a liquid thermodynamic state (droplets), but also to a solid state (ice packets), if a compressed ambient air mass flow with the required temperature, pressure, and humidity conditions is fed to a convergent-divergent nozzle and is allowed to expand with the necessary thermal protections.

Furthermore, flame aerodynamics is well known to be involved in the survival of the steady chemical reaction that permits a combustion process to remain and grow. Disruption of atmospheric flames aerodynamic natural conditions by external (non-natural) fluid mechanisms (high speed air jets), can bring about the flames blown off and the extinction of the combustion process.

Different new inventions for fire control systems studied in the prior art literature, keep using water sprays or mists as their active agent (water droplets), but those systems, on the one hand, only pulverize water from an initial equivalent liquid state utilizing different innovative atomization techniques, and therefore, maintain the water supply limitation and a diminished capability to handle intense fires due to the untimely water droplets evaporation before reaching the flames' origin. On the other hand, new fire control systems also incorporate particular aspersion methods to deliver their active fire fight agent to the flames' origin (including direct water jets), but all these aspersion methods do not include any additional fluid mechanisms to penetrate the flame front and disrupt the natural aerodynamic conditions bringing about the flame blown off, and therefore remain totally dependent on a process of cooling, wetting and even flooding the flames site to extinguish the fire, with an important water consumption and consequently a not continuous intense fire fight work.

A wide category of other new fire control systems studied, use different approaches with chemical agents (gas, liquid and solid), foams and catalytic surfaces, but all these systems are unable to use ambient air jets specifically as its flame suppressor agent and/or mechanism, and therefore remain implicitly characterized by a limited fire fight effectiveness due to the fact that they are totally dependent, not only again on the supply, but also on the aspersion mechanism of their respective, and only, fire control agent, with a poor, if any, individual deliberate mechanism to attack the flames' natural aerodynamic conditions.

Other inventors in the prior art mention or describe systems that use convergent-divergent nozzles to condensate different vapors including pure water vapor (steam), utilizing normal or condensation shocks waves in supersonic flows, but none of these systems has the specific purpose of fire control and no one gets water vapor from the ambient air involved as the working substance motive of the given invention.

None of the patents and applications consulted, either teaches or suggests the "ambient-air jet blast flames containment and suppression system" motive of the invention herein presented, characterized by its main active fire control agent, by its containment and aspersion methods, and by its aerodynamic flame suppression and combustion inhibition mechanisms.

REFERENCES TO SPECIFIC DOCUMENTS

| | | |
|---|---|---|
| Haessler. | U.S. Pat. No.: 3463233 | August, 1969. |
| Duncan. | U.S. Pat. No.: 3584688 | June, 1971. |
| Dockery. | U.S. Pat. No.: 3653443 | April, 1972. |
| Chiarelli. | U.S. Pat. No.: 3691936 | September, 1972. |
| Banner. | U.S. Pat. No.: 3866687 | February, 1975. |
| Dunn. | U.S. Pat. No.: 3889754 | June, 1975. |
| Ward. | U.S. Pat. No.: 3897829 | August, 1975 |
| Tomlinson. | U.S. Pat. No.: 4090567 | May, 1978 |
| Gaylord. | U.S. Pat. No.: 4356870 | November, 1982. |
| Mingrone. | U.S. Pat. No.: 4524835 | June, 1985. |
| Mikulec. | U.S. Pat. No.: 4813487 | March, 1989. |
| Silverman. | U.S. Pat. No.: 4834188 | May, 1989. |
| Stehling. | U.S. Pat. No.: 5127479 | July, 1992. |
| Meister. | U.S. Pat. No.: 5129386 | July, 1992. |
| Fox. | U.S. Pat. No.: 5165483 | November, 1992. |
| Smagac-Breedlove. | U.S. Pat. No.: 5165482 | November, 1992 |
| Fissenko. | U.S. Pat. No.: 5275486 | January, 1994 |
| North. | U.S. Pat. No.: 5297636 | March, 1994. |
| Roberts-Butz. | U.S. Pat. No.: 5597044 | January, 1997 |
| Stehling. | U.S. Pat. No.: 5697450 | December, 1997. |
| Stehling. | U.S. Pat. No.: 5871057 | February, 1999. |
| Yen. | U.S. Pat. No.: 6173791 | January, 2001. |
| Blount. | U.S. Pat. No.: 6444718 | September, 2002 |
| Adiga. | U.S. Pat. No.: 6474420 | November, 2002 |
| Taylor. | U.S. patent application Ser. No.: 20020185283 | December, 2002 |
| Yen. | U.S. Pat. No.: 6510901 | January, 2003. |

-continued

| | | |
|---|---|---|
| Demole. | U.S. patent application Ser. No.: 20030094287 | May, 2003 |
| Olander-Schall | U.S. patent application Ser. No.: 20030062175 | April, 2003 |

BRIEF SUMMARY OF THE INVENTION

This invention relates to a complete arrangement of mechanical components, establishment of heat transfer and aero-thermodynamic processes, the utilization of an active fire control agent and innovative containment and aspersion mechanisms, which all together configure a new system for flames suppression and combustion inhibition.

In this invention, an ambient air mass flow is compressed in the fire location, transported to a particular flames site by a hose and pipes, fed to a jacketed (thermally protected) convergent-divergent nozzle where it expands, generating thereinto a condensation shock wave, producing finally, a high speed ambient air jet containing water droplets which is directed upon the flames' origin.

This ambient air jet is characterized by a high flame front penetration capability, and so, this high energy air jet is able to blast and disrupt strongly the flames natural aerodynamic conditions up to their origin, bringing about the flames blown off.

Additionally, other directional and exhaust air jets, create flames containment mechanisms or barriers, which concentrate the aerodynamic flame suppression action of this invention on a given flames' origin.

Different modified forms of this invention are herein presented, which, on the one hand, enhance or improve the original aerodynamic flames suppression and containment mechanisms, and on the other hand, increase the system's usefulness to be able to intervene in chemical fire fights using its aspersion mechanisms to deliver different needed chemical agents to the flames site.

More specifically, the invention herein presented relates to a new process of suppressing or annihilating flames by the aero-thermodynamic beneficial coupling of different ambient air factors, wherein are included: humidity (water vapor) present in the ambient or atmospheric air, separation and thermodynamic behavior of gas mixtures components, heat transfer and gas dynamics or compressibility effects of ambient air.

In the original form of the presented invention, atmospheric air, been a gas mixture (dry air and superheated water vapor) is used as the sole fire fight agent and working substance needed to activate its flames suppression, flames containment, and aspersion mechanisms, and therefore, this new system of fire control has unlimited, continuous and immediate supply of its (natural) necessary fire fight agent.

In atmospheric fires, buoyancy forces originated from strong temperature gradients, air density changes, and natural convective air flows, allow flames to survive receiving the required oxygen flow for a stable chemical reaction when the necessary natural flame front aerodynamic conditions are steadily established, but these natural flows and aerodynamic conditions can be strongly destabilized and the flame blown off, only by the inertial and pressure forces generated by a high speed ambient air jet, whose total momentum creates the necessary flame front penetration capability to reach and blast the flames' origin, without any further chemical reaction been involved in this aerodynamic interactions process.

Additionally, as ambient air is a gas mixture containing humidity (water vapor), this invention can readily separate this component from such a mixture as water in a liquid state (droplets), and therefore, also uses for the practical purpose of suppressing flames, the water present only in the atmospheric air as a booster fire control mechanism, because liquid water is very effective not only as a flame suppressor but also as a combustion inhibitor.

The present invention, permits the utilization of water droplets, obtained only from the local ambient air through an aero-thermodynamic condensation separation process, as an additional fire control mechanism, and together with the flame front penetration capability of a high speed air jet emerging from a thermally insulated convergent-divergent nozzle, give this invention the necessary characteristics to be different from prior art fire control systems.

The fire control system of this invention, in its modified forms, use different air jets and solid accessories to create flame containment mechanisms to enhance its flame suppression capabilities, and also, to permit the utilization of its aspersion mechanism to deliver different chemical agents to a flames site.

Although this new fire control system can not be classified as "portable", its availability is unlimited to reach remote, difficult or non-accessible fire locations (mountains, forests, plateaus, grasslands) in the required short time via helicopter. Due to its considerable action radius, the "flames suppression curtain" that can be created with a set or group of these new systems, can be a beneficial protection mechanism even for wind blowing forests fires path communities.

This invention operation costs, are high, due to the required compressor unit operation point (discharge pressure and air mass flow) and consequently, engine or motor power, but for forest fires, helicopter and airplane fire fighting methods using water or other chemical agents, are quite more expensive methods, and their effectiveness has demonstrated not to be the required one.

Capital investment cost to acquire the fire fight systems of this invention, are however, quite lower than the cost of the methods afore mentioned for forests fires.

The different criteria used or defined to evaluate the effectiveness of forest fires fight methods include: the size of burning area blown off per unit of time, per unit of dollar spent, and the man power required. The new fire fight system herein presented drastically outperforms the shovel and dirt (soil) and many other manual methods, can handle big intense flames, is environment friendly, and precludes the need to tear down trees.

This invention's advantages are: a free, unlimited, and immediate supply of its main flame suppression agent (ambient air), an agile and prompt distribution of these fire fight systems to the fire locations via helicopter, long and continuous fire fight times (including night shifts), and for high design capacity systems, a good 400 meters long (quarter of mile) fire-fight front line per system using 4 of the described hoses spread evenly apart with 4 or 8 fire fighters depending on the fire scene (grasslands or trees), and also, incorporates the capability (in its modified forms) to carry on the aspersion of different chemical fire fight agents even in chemical fires.

Its disadvantages are: big, relatively heavy compression package (for high design capacity units), even so, within the limits of helicopters that are prepared for cargo lift, including if necessary, the so called "sky-cranes"; and also, extremely dry weathers, because although the main flame suppression mechanism will be still active (high flame front penetration air jets), the system will not be able to boost enough, at least, with big water droplets, the aforesaid fire fight aerodynamic mechanism, unless liquid water is externally supplied as a fire fight agent using one of its modified forms.

BRIEF DESCRIPTION OF THE SEVERAL VIEWS OF THE DRAWINGS

The technical characteristics, details, and different modified forms of this invention, are described in the figures presented in the 14 pages herein included.

DETAILED DESCRIPTION OF THE INVENTION

The objective of the invention herein presented is to provide method and apparatus to efficiently and effectively suppress flames, through the use of a fire location ambient air compression process, and a subsequent calculated convergent-divergent nozzle thermally protected air flow expansion, to separate the gas mixture components generating a high speed air jet containing water droplets, creating the necessary flames containment mechanisms, and also for the needed aspersion of different chemical agents.

FIG. 1.

Figure 1:
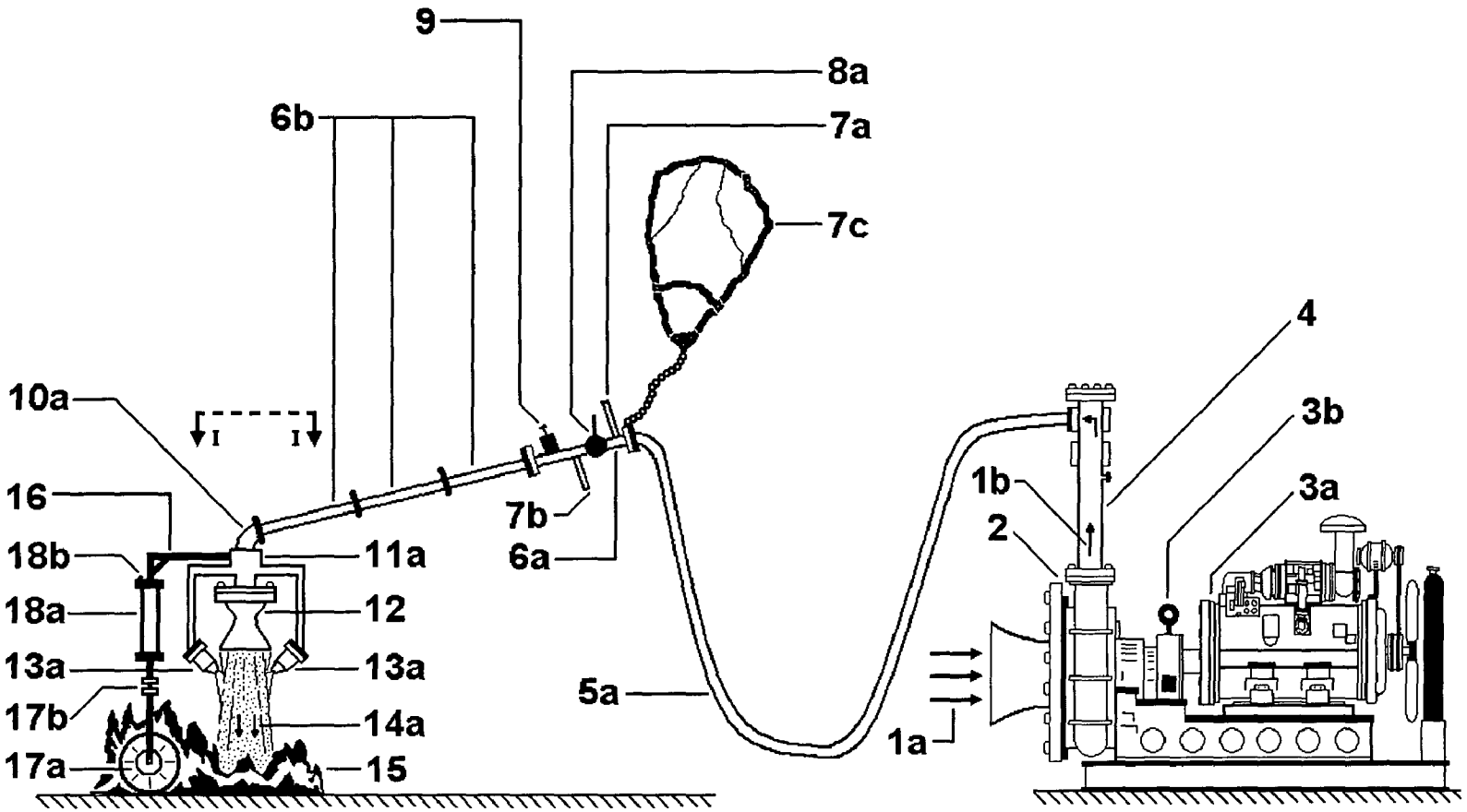
FIG. 1 corresponds to a side vertical or elevation overview of the complete fire fight system of this invention, already set up in a fire location as the operator (fire fighter) should manipulate it. Herein is presented a general view and description of the technical details of the complete ambient-air jet blast flames containment and suppression system including components and processes, in its original form for a common flames suppression situation. (arrows indicate air flows or discharge air jets).

FIG. 1 shows a side vertical or elevation overview of the fire fight scene or location where the complete ambient-air jet blast flames containment and suppression system of this invention is set up and ready for fire fight work.

This system's process begins when an ambient air mass flow 1*a* (a mixture of dry air and superheated water vapor) at local atmospheric conditions, enters the suction of the compressor unit 2 (centrifugal or axial rotors), wherein, said ambient air mass flow 1*a*, is compressed, increasing its pressure and temperature. Said compressor unit 2, is driven by the power-drive 3*a* (gasoline, diesel engine or electrical motor).

Said compressor unit 2, does not include any dehumidifier equipment, and the water vapor mass initially present in said ambient air mass flow 1*a*, is conserved in this compression process. On the other hand, such compressor unit 2, includes an operation point automatic control system (variable: inlet-guide-vanes angle [pre-rotation], or compressor rotors angular velocity) to be able to maintain a prescribed or indicated constant discharge pressure with a variable operating air mass flow, without any incursions in unstable (rotating stall) operating regimes.

A compressed ambient air mass flow 1*b* (still a mixture of dry air and superheated water vapor), is consequently, continuously produced at the fire location, and emerges from the discharge of said compressor unit 2.

The exhaust manifold 4, receives and accumulates said compressed ambient air mass flow 1*b*, and permits its distribution to the flames sites.

The compression package assembly, which includes: the compressor unit 2, the power drive 3*a*, and the exhaust manifold 4, can be transported to remote fire locations (forests, other communities) via helicopter or other suitable vehicle using the hook's keeper 3*b*.

Said exhaust manifold 4, permits the connection of the hose 5*a*, by means of which, said compressed ambient air mass flow 1*b*, is transported to the flames site, which is a prudent distance away, but the total length of said hose 5*a* can reach a calculated factor of several hundred meters (system's action radius), and said exhaust manifold 4, has the design capability for the connection of more than one hose, depending on said compressor unit 2 mass flow capacity and compression ratio (stable operation range) and on said power-drive 3*a* horsepower design parameters. All of these, are different variables and parameters that all together establish the system's overall flame suppression design capacity, fire-fight front line length (action radius), and operation characteristics.

Said compressed ambient air mass flow 1*b*, transported a given distance away by said hose 5*a*, which is connected to the control manipulator pipe 6*a*, then reaches or arrives to the flames site.

On said control manipulator pipe 6*a*, are installed: the operator's manual supports or handles 7*a* and 7*b*, which, with the aid of suspenders or shoulder harness 7*c*, allow the operator to sustain, move and manipulate the system; the air throttle valve 8*a*, installed to control the quantity of said compressed ambient air mass flow 1*b*; and also is installed the pneumatic control 9, which purpose is described in a subsequent paragraph.

A variable number of coupled extension pipes 6*b*, permits the system to acquire different configurations of variable length, depending on the physical and thermal circumstances present in the flames site and for the sake of operator's safety.

The rotary elbow accessory 10*a*, permits the compressed ambient air mass flow 1*b*, to acquire the necessary angle of attack or direction for different flame suppression activities, including vertically downwards.

Said compressed ambient air mass flow 1*b*, then reaches the distribution manifold header 11*a*, whereon, among other internal components, are installed: the outer convergent-divergent nozzle 12, and two directional convergent nozzles 13*a*.

Finally, after the fire control aero-thermodynamic process takes place in the internal components, a high speed ambient air jet containing water droplets 14*a*, with a high aerodynamic flame front penetration capability and able to reach and blast the flames' origin, can be directed upon the flames 15 by the operator.

Additional components attached to said distribution manifold header 11*a*, where the aero-thermodynamic fire control process takes place, generating said high speed ambient air containing water droplets 14*a*, and the internal details of said outer convergent-divergent nozzle 12, will be described in the sectional view of FIG. 3A and in the plan view of FIG. 3B.

In this FIG. 1, the frame or support 16, can be optionally installed on said distribution manifold header 11*a*, permitting, on the one hand, the utilization of wheel 17*a*, which establishes a rest-on or support point for more rapid and accurate scan or sweeping operator's movements on burning materials in solid surfaces (grasslands, wooden roof tops).

Furthermore, vertical rotation attachment 17*b*, permits said wheel 17*a* axle to have a variable orientation, and therefore, said wheel 17*a* variable or adjustable steering angle, allows sideways or back and forth flames suppression sweeping operator's movements on solid surfaces (parallel or perpendicular to a fire line on the ground, respectively).

And, on the other hand, said support 16 also permits the utilization of the pneumatic cylinder 18*a*, which can be operator activated through aforesaid pneumatic control 9, using the connection point 18*b* to allocate the required pneumatic pressurized line from such control. Said pneumatic cylinder 18*a* total run, is used to regulate or adjust the proximity or distance between the flames 15 origin and said outer convergent-divergent nozzle 12 discharge line, habilitating the operator: to manage obstacles (rocks, tall weeds, fallen logs); to increase the air jet flame front penetration and blast effectiveness, and also, to actually wet (water), if required, any remains of not burned combustible materials after the flames' blown off (combustion inhibition), specially in strong wind blowing situations, red glowing ashes, high thermal radiation, and long, big, intense surrounding flames.

FIG. 2.

Figure 2:
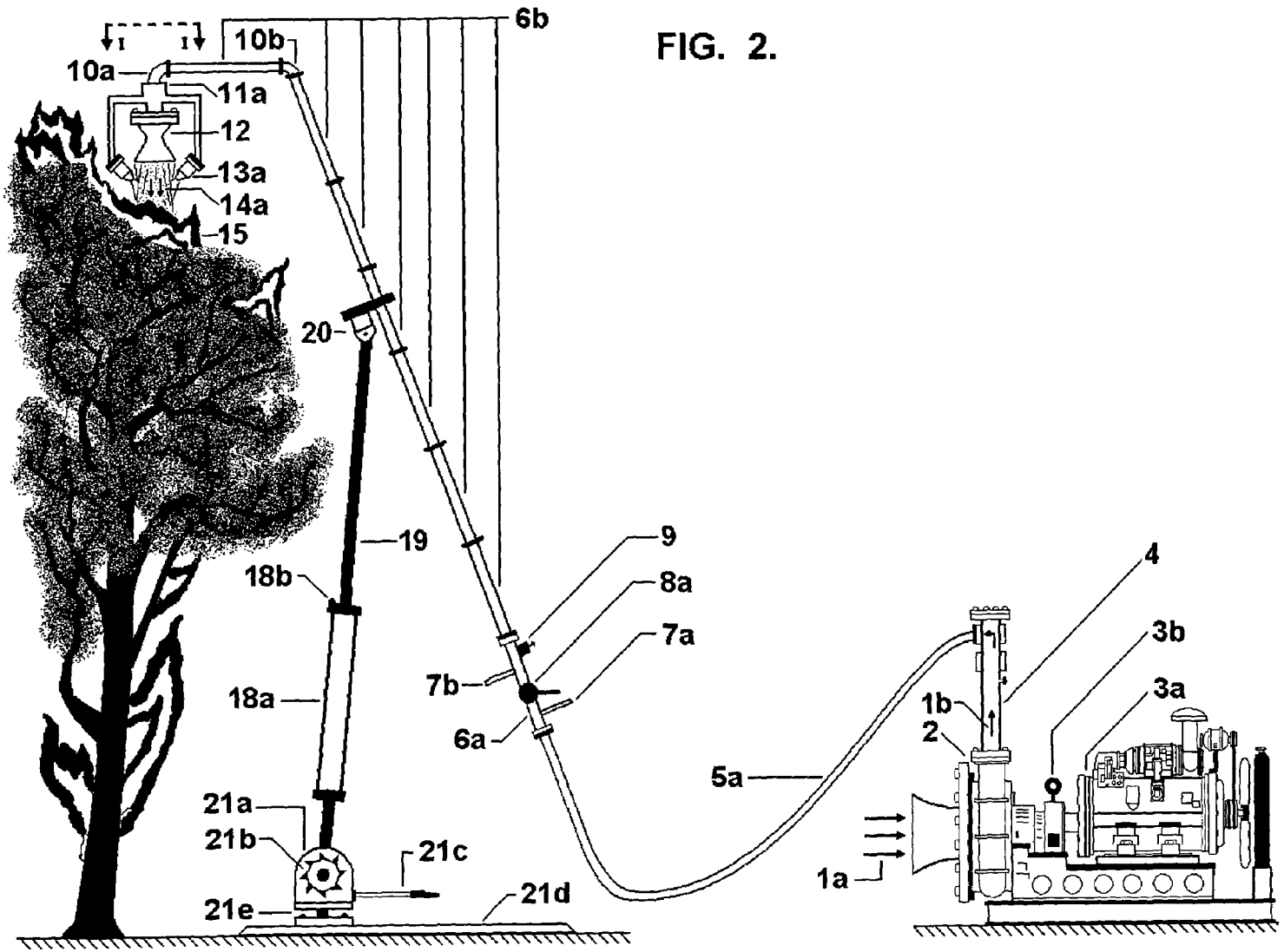
FIG. 2 corresponds to a side vertical or elevation overview of a complete modified form of this fire fight system, already set up in a fire location as the operator (fire fighter) should manipulate it. Herein is presented a general view and description of the components and processes of this modified form of the complete fire fight system of this invention prepared for a different kind of flames suppression need, with characteristics not specifically covered in prior art fire control systems. (arrows indicate air flows or discharge air jets).

FIG. 2 shows a side vertical or elevation overview of a fire fight scene or location, where a complete modified form of this invention is set up and ready for fire fight work.

In this FIG. 2, the utilization of pole support 19 and elbow accessory 10*b*, permit the operator to rapidly reach and process burning materials or flames 15, otherwise inaccessible in a fire fight scene as depicted.

A multiple coupling of said extension pipes 6*b*, allows to set up system's configurations of variable length, conforming inclusively a long fire-fight boom assembly.

In this modified form presented in FIG. 2, upper pivoted anchor 20, lower double-action pivoted anchor 21*a*, and said pole support 19, allow the necessary swivel, back and forth, and also vertical rotation operator's movements for an effective flame suppression work under this kind of fire fight scenes (trees, tall walls, wooden posts, elevated coated wires or pipes, or industrial installations).

Said lower double-action pivoted anchor 21*a*, on the one hand, incorporates a ratchet wheel pivot 21*b*, to prevent unwanted forth rotations or movements depending on the boom's variable center of gravity position, and which can be operator controlled with release pedal 21*c* when the operator is standing on platform 21*d* for stability purposes, so the operator is not self supporting a long fire fight boom in active fire-fight maneuvering circumstances in a particular flames site (tree or wall) at a fire location.

On the other hand, said lower double-action pivoted anchor 21*a*, furthermore incorporates a vertical rotation attachment 21*e*, which allows additionally the boom's vertical rotation, for rapid and efficient spread-out trees limbs or wide walls, flames suppression sideways operator's movements.

Here again, said pneumatic cylinder 18*a*, permits a rapid change of the boom's vertical position or distance to the flames 15 origin without the operator continually repositioning horizontally said lower double-action pivoted anchor 21*a* installed on said platform 21*d*, in a given flames site (tree or wall), been able to perform a rapid fire fight sweep on a big burning volume or area.

The variable orientation (rotation angle) of said rotary elbow accessory 10*a*, permits different attitudes: downwards, lateral, and inclusively a vertical upwards direction, of said high speed ambient air jet containing water droplets 14*a*, beneficial jet's attitudes in some physical flame circumstances (burning tree tops or limbs, tall weeds, foliage sweeping and wetting, and also, for line of fire alterations or break-ups).

The modified form of this invention depicted in FIG. 2, has enough degrees of freedom and ergonomics to permit any required operator's flame suppression movements and long fire fight times.

Repositioning the fire fight boom from one local flames site to another, if the length of said hose 5*a* allows, does not require more than two men once the boom is fully in-location assembled with a particular required number of said extension pipes 6*b*, conforming a fire suppression in-site man-transportable boom assembly.

Said high speed ambient air jet containing water droplets 14*a* aerodynamic flame front penetration, blast, and blown off capabilities, are very sensitive or depend strongly on said outer convergent-divergent nozzle 12 discharge line proximity to the flames' origin, and so, the operator has to be able to move and position this discharge line as close as possible to any given flames' origin in a particular flames site. High ambient air mass flow (and water vapor) capacity systems can accomplish a throughout wet seconds after the flames' blown off, precluding any re-inflammation of not burned materials.

Any propulsion effects generated by the system's nozzles, are overcome by the total weight of the accessories or mutually cancel out.

Temperature gradients and levels in all solid accessories or components in contact with the flames, on the one hand, are controlled by the intense heat transfer rate developed by said compressed ambient air mass flow 1*b* itself in any solid component, dissipating enough heat to avoid any structural deformations or operator's problems. On the other hand, components with no flow at all, require the use of high temperature alloys, refractory materials, or thermal insulations to preclude damages and operational problems.

FIG. 3A.

Figure 3A:
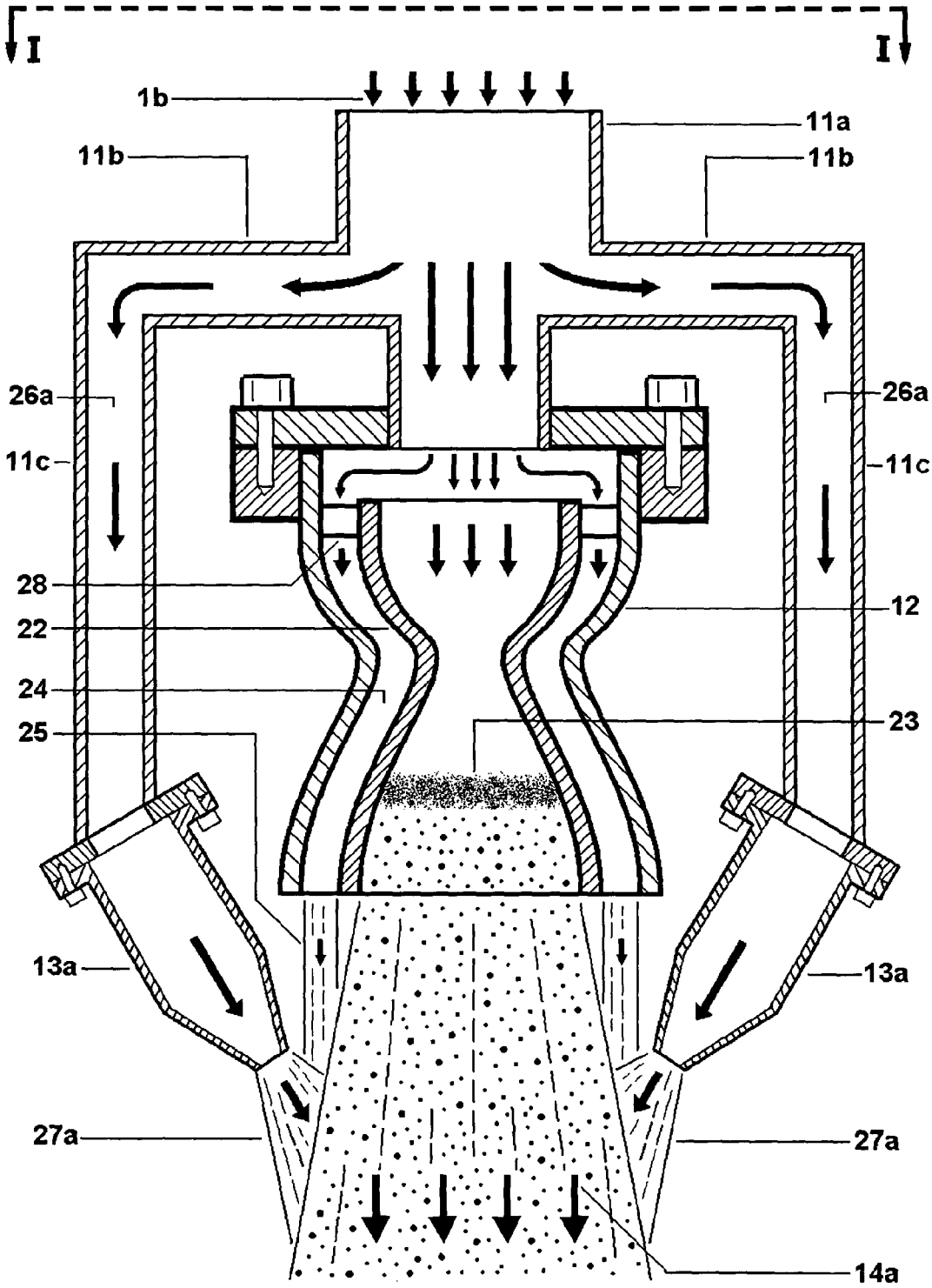
FIG. 3A describes a side vertical or elevation sectional view (the plane upon which this sectional view is taken, is indicated as II—II in FIG. 3B) of the internal components of this system where the aero-thermodynamic fire control process takes place, internal components corresponding to the complete embodiments presented in FIGS. 1 and 2 (this same sectional view pertains to those two figures). These internal components generate the high speed ambient air jet containing water droplets described in such FIGS. 1 and 2. (arrows indicate internal air flows or discharge air jets).
Figure 3B:
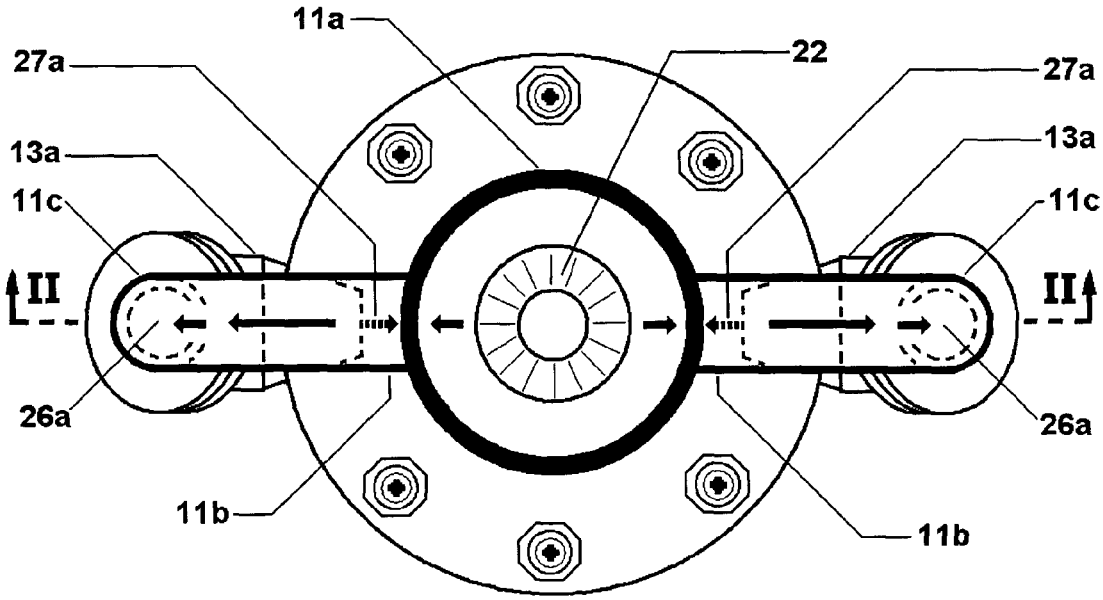
FIG. 3B presents, according now to the plan or top I—I view indicated in FIGS. 1, 2 and 3A, the same internal components of this system where the aero-thermodynamic fire control process takes place, already described in FIG. 3A. (arrows indicate internal air flows or discharge air jets).

FIG. 3A describes a side vertical or elevation sectional view (the plane upon which this sectional view is taken, is indicated as II—II in FIG. 3B), corresponding to the same side vertical overview of FIGS. 1 and 2, and wherein are presented the details of the internal components where the aero-thermodynamic flame suppression process takes place.

In this FIG. 3A are included: the detailed description of said distribution manifold header 11*a*, said outer convergent-divergent nozzle 12, said directional convergent nozzles 13*a*, and all the other internal components involved in the aero-thermodynamic process producing said high speed ambient air jet containing water droplets 14*a*.

In FIG. 3A, said distribution manifold header 11*a*, receives the total of said compressed ambient air mass flow 1*b* from said rotary elbow accessory 10*a* located upstream. In said distribution manifold header 11*a*, the compressed ambient air mass flow 1*b*, is then divided in different partial compressed ambient air mass flows. (arrows indicate air flows).

Jacketed convergent-divergent nozzle 22, receives and expands part of said compressed ambient air mass flow 1*b*, and thereinto is established the condensation shock wave 23, in an internal axial position, where the expanding gas mixture reaches the dew point temperature of the water vapor contained in such a mixture according to the partial pressures (specific humidity), producing the water droplets of said high speed ambient air jet containing water droplets 14*a*.

Said condensation shock wave 23 axial position within said jacketed convergent-divergent nozzle 22, is a controllable design variable, so the pressure and temperature parameters of the formed liquid droplets, can be so established, as for the droplets' liquid state belongs completely to the sub-cooled or compressed liquid thermodynamic state, without any remains of saturated vapor components and thermodynamically far from any internal re-vaporization process, obtaining the biggest quantity possible of liquid water from the local atmospheric air water vapor contents.

As the geometrical characteristics (area ratios and contours) of said jacketed convergent-divergent nozzle 22, are a design variable affecting the air's (mixture) expansion, a set of geometrically different nozzles will be available to the operator, which can be utilized in different prescribed ranges of local ambient air conditions and humidity contents, different nozzles which can be rapidly installed in position on said distribution manifold header 11*a* as will be indicated in a subsequent paragraph.

Although the formation of ice packets has been verified by the inventor in some particular laboratory tests, those tests were performed with a high humidity contents in the local ambient air expanded, but this aero-thermodynamic separation process always includes the possibility, and said high speed ambient air jet containing water droplets 14*a*, could include also, in some actual situations, ice packets for the additional benefit of the purpose of this fire control invention.

Conversely, forest fires usually are related to dry weather conditions (low ambient air humidity, droughts), so on the other hand, a high speed "dry" air jet blast by itself, has the capability to penetrate the flames fronts up to their origin, blast them, and bring about such flames blown off, so the water droplets are beneficial as a booster mechanism, but they are not necessary to blast their origin and suppress the flames.

Even dry or dehydrated materials (including vegetables or plants), release vapors when they are in combustion. In a forest fire situation, depending on wind blowing direction and operator's smoke protection, ambient air with a content of those vapors (including water vapor) can be used in this invention in a dry weather condition forest fire fight. If the situation demands it, one of the presented modified forms of this invention can be used with an external supply of water.

What is maintained in all these circumstances, is the aerodynamic flame front penetrating ambient air jet blast mechanism of this invention, and its capability to use, as its sole fire fight agent, the ambient air available in the natural fire location.

Said high speed ambient air jet containing water droplets 14*a*, performs a two fold fire control mechanism on said flames 15. The air jet penetrates, blast and disrupts the flame front natural aerodynamic conditions and brings about the flame blown off notwithstanding the total water droplets re-evaporation during this process in their trajectory to the flame's origin, subsequently, after the flame's blown off, the water droplets can, cool, wet and inhibit remaining not burned materials combustion.

Aforesaid air throttle valve 8*a*, allows the control of said jacketed convergent-divergent nozzle 22 compressible flow operation regime.

In the over-expanded supersonic operation regime, said jacketed convergent-divergent nozzle 22, produces a lower than ambient pressure discharge flow with external discontinuities (Mach waves), and said high speed ambient air jet containing water droplets 14*a*, with an absolute pressure lower than the ambient local absolute pressure, generates suction flow inertial forces or inward pressure forces in the flames front surrounding air field, breaking down the vorticity field created naturally by the flames, and permits a localized blown off non-scatter action on flame fronts, precluding the inflammation of neighboring non-burning materials.

In the under-expanded supersonic operation regime, said high speed ambient air jet containing water droplets 14*a*, emerging with an absolute pressure bigger than the local ambient pressure, expands out after discharge and increase the burning area covered by the air jet blast and water droplets action.

Depending on the physical fire circumstances, fire location ambient air conditions, the characteristics of the flames, and the kind of burning material, is the operator's decision to modify said jacketed convergent-divergent nozzle 22 compressible flow operation regime through the use of said air throttle valve 8*a*, with the existence or not of water droplets in the emerging air jet depending strictly on the air jet thermodynamic state parameters (absolute pressure and temperature).

Internal compressed ambient air mass flow expansion in said jacketed convergent-divergent nozzle 22, necessary to decrease pressures and temperatures in the flow to successfully establish said condensation shock wave 23 in an internal adiabatic process, requires a heat transfer shield component to insulate the flow from the high temperature flame surroundings.

Insulation flow passage 24, allows the necessary cooling air mass flow region between said jacketed convergent divergent nozzle 22 and said outer convergent-divergent nozzle 12, to control the heat transfer rate from the outside hot environment allowing the low temperature required conditions in the internal flow expansion of said jacketed convergent-divergent nozzle 22.

The compressed air mass flow in said insulation flow passage 24, works as a thermal insulator allowing low air temperatures and the successful establishment of said condensation shock wave 23 in the nozzle, even in the high temperature outer environment of the flames site.

Consequently, discharge flow jet 25 (annular jet for conical nozzles, or rectangular section jet for plane nozzles) from said insulation flow passage 24, works as an additional surrounding external heat shield or cushion to prevent emerging water droplets from an earlier re-vaporization and size reduction, increasing the flame blown off and combustion inhibition capabilities of said high speed air jet containing water droplets 14*a*.

Structural integrity is maintained by a set of supports or struts 28 (radial for conical nozzles or cross-bar for plane nozzles) positioned between said outer convergent-divergent nozzle 12 and said jacketed convergent-divergent nozzle 22, joining them structurally and conforming a unit interchangeable rapidly installed in position "blast-gun" incorporating, as needed, the aforementioned set of different nozzles.

Furthermore, in this FIG. 3A, two horizontal ducts or pipes 11*b*, emerge from said distribution manifold header 11*a*, and together with two vertical ducts or pipes 11*c*, conform a pair of the complete flow passages 26*a*, which transport the necessary partial amount of compressed ambient air mass flow 1*b*, to feed aforesaid directional convergent nozzles 13*a*.

Said directional convergent nozzles 13*a*, produce discharge air jets 27*a*, which create an axis of, or apply an, aerodynamic containment mechanism in one direction to said high speed ambient air jet containing water droplets 14*a* when it reaches or impinges on the burning material or flames' origin, precluding the existence in such direction of secondary outward tangent air flows than can produce scurrying or runaway flame fronts, and canceling out the possibility of feeding with the necessary oxygen and make grow adjacent flame fronts in the given axis direction.

FIG. 3B.

FIG. 3B presents the same internal components and partial compressed ambient air mass flows already described in FIG. 3A, according now to the plan or top I—I view indicated in FIGS. 1 and 2, and also in such FIG. 3A.

In this view of FIG. 3B, two horizontal ducts or pipes 11*b* emerge from said distribution manifold header 11*a*, conforming together with two vertical ducts or pipes 11*c*, an equal number of flow passages 26*a*. Also, two directional convergent nozzles 13*a*, are installed, creating with said discharge air jets 27*a*, the aerodynamic flame containment mechanism described.

For a better identification, not visible air flows and components, pertaining to this plan view, are indicated by broken arrows or phantom (dashed) lines, respectively.

FIG. 4A.

Figure 4A:
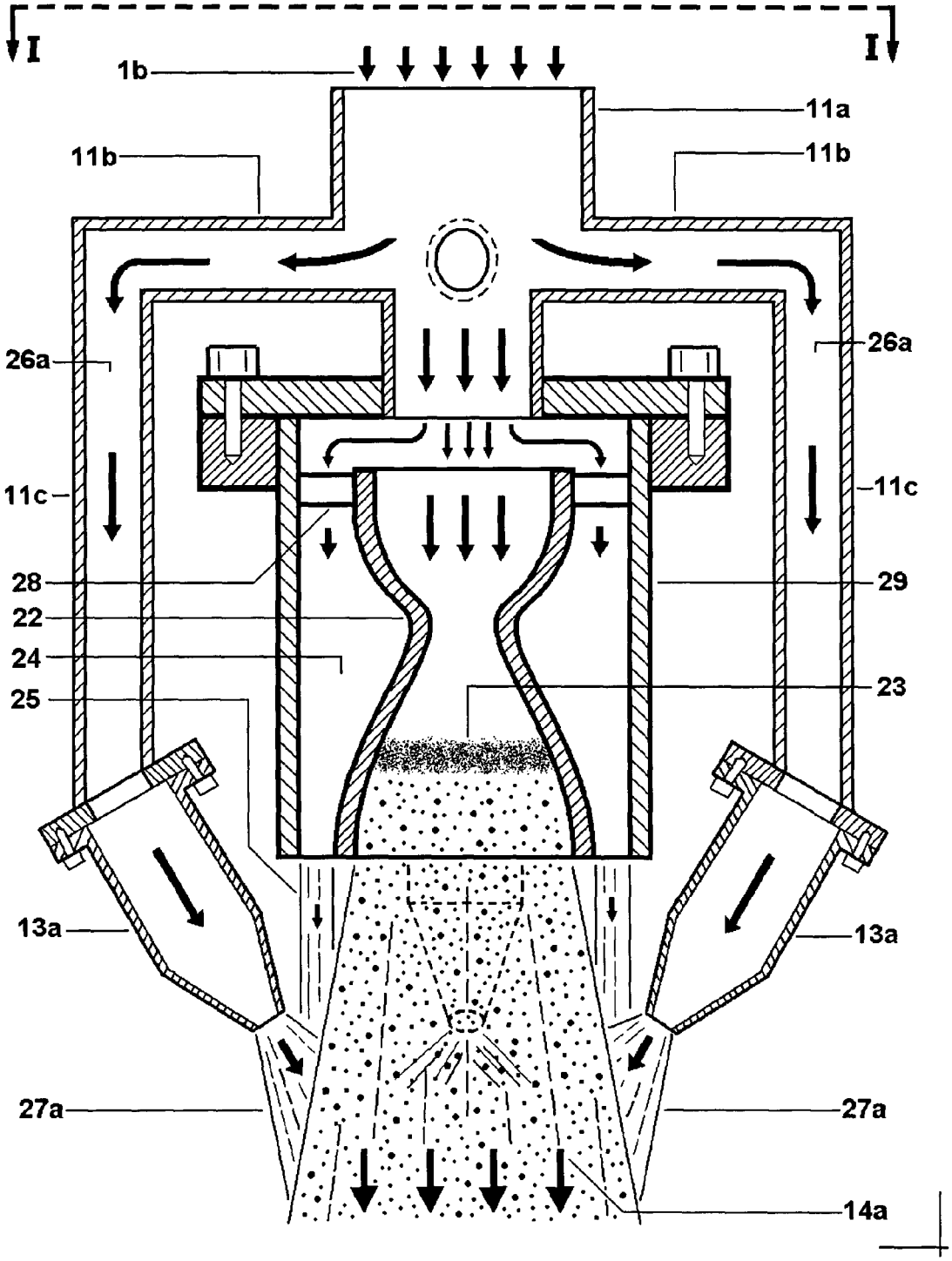
FIG. 4A describes a side vertical or elevation sectional view (the plane upon which this sectional view is taken, is indicated as III—III in FIG. 4B) of a modified form of the internal components of this system where the aero-thermodynamic fire control process takes place, increasing to four the number of the indicated individual flame containment jet flows and replacing one component as described in FIG. 3A, for an improved flames suppression and aerodynamic containment capability and fabrication costs reduction purposes. (arrows indicate internal air flows or discharge air jets).

FIG. 4A shows a modified form of this invention with respect to the original form of the internal components depicted in FIG. 3A.

Figure 4B:
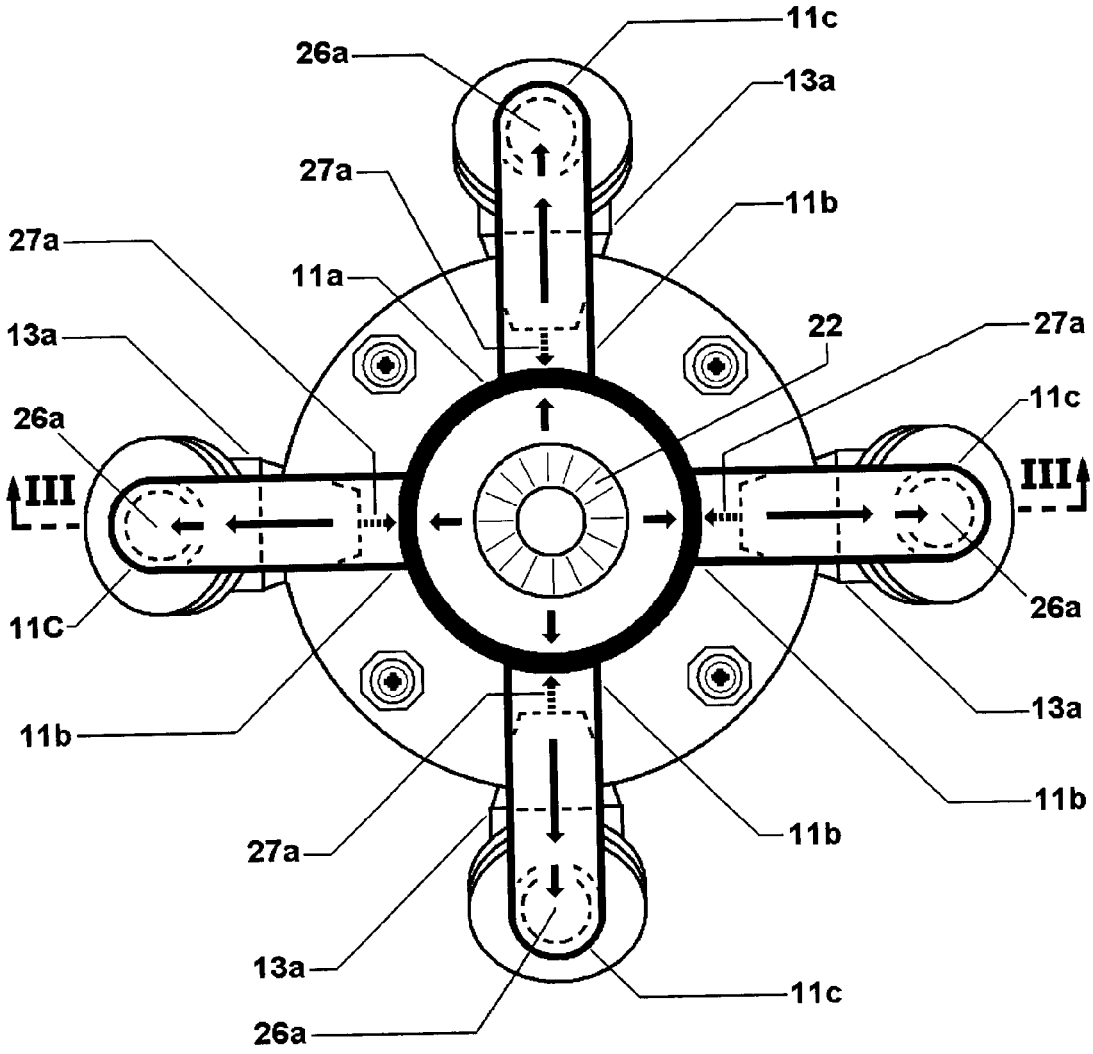
FIG. 4B presents the same modified form of the internal components already described in FIG. 4A, according to the plan or top I—I view indicated in such FIG. 4A. (arrows indicate internal air flows or discharge air jets).

This FIG. 4A presents a side vertical or elevation sectional view (the plane upon which this sectional view is taken, is indicated as III—III in FIG. 4B) of the modified internal components, and wherein, on the one hand, outer straight duct 29 (cylindrical for a conical nozzle 22, or rectangular for a plane nozzle 22), replaces said outer convergent-divergent nozzle 12 as described in such FIG. 3A, only for production or fabrication costs reduction purposes and conforming also a more sturdy and practical "blast-gun".

On the other hand, in this modified form, with respect to FIG. 3A, the number of directional convergent nozzles 13*a* and corresponding components of the distribution flow passages 26*a*, have been increased to four, to incorporate a new perpendicular axis for the flames aerodynamic containment mechanism mentioned before, improving the versatility of the system for the orientation needed in a particular flame site or fire line.

As properly required for the plane taken in this sectional view, only phantom (dashed) lines for the additional internal components herein included, can be shown. For a better identification, see the plan view in FIG. 4B.

FIG. 4B.

FIG. 4B presents the same internal components and partial air mass flows already described in FIG. 4A, according to the plan or top I—I view indicated in FIGS. 1 and 2, and in such FIG. 4A.

In this FIG. 4B, four horizontal ducts or pipes 11*b* emerge from said distribution manifold header 11*a*, conforming together with four vertical ducts or pipes 11*c*, an equal number of four flow passages 26*a*. Also, four convergent directional nozzles 13*a*, are installed, creating with four discharge air jets 27*a*, an improved, two perpendicular axes, aerodynamic flame containment mechanism.

For a better identification, not visible air flows and components, pertaining to this plan view, are indicated by broken arrows or phantom (dashed) lines, respectively.

FIG. 5A.

Figure 5A:
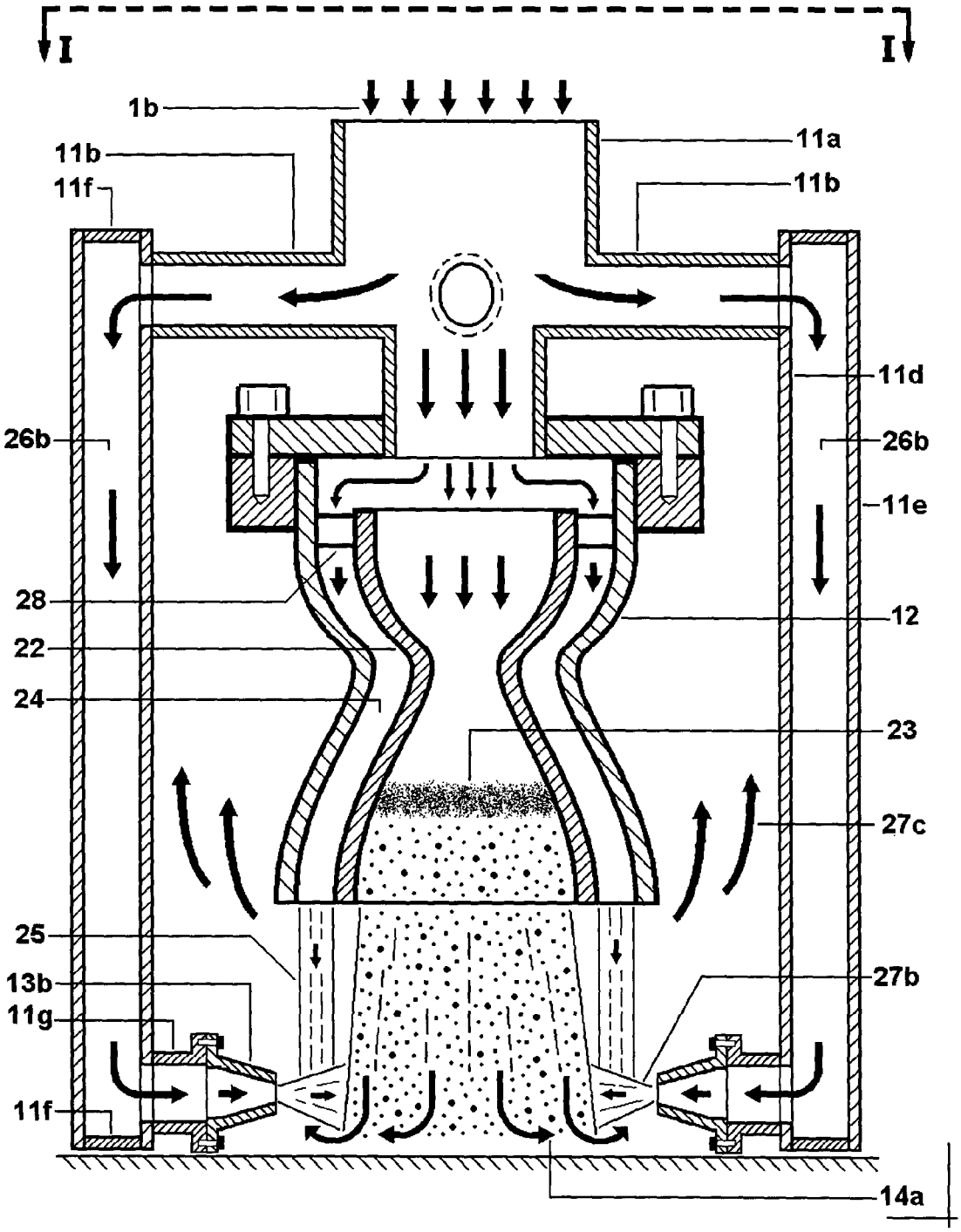
FIG. 5A describes a side vertical or elevation sectional view (the plane upon which this sectional view is taken, is indicated as IV—IV in FIG. 5B) of another modified form of the internal components of this system where the aero-thermodynamic fire control process takes place, replacing some of the accessories as described in FIG. 4A, for an advanced, radial, circumferentially distributed, air jet flame containment aerodynamic mechanism. (arrows indicate internal air flows or discharge air jets).
Figure 5B:
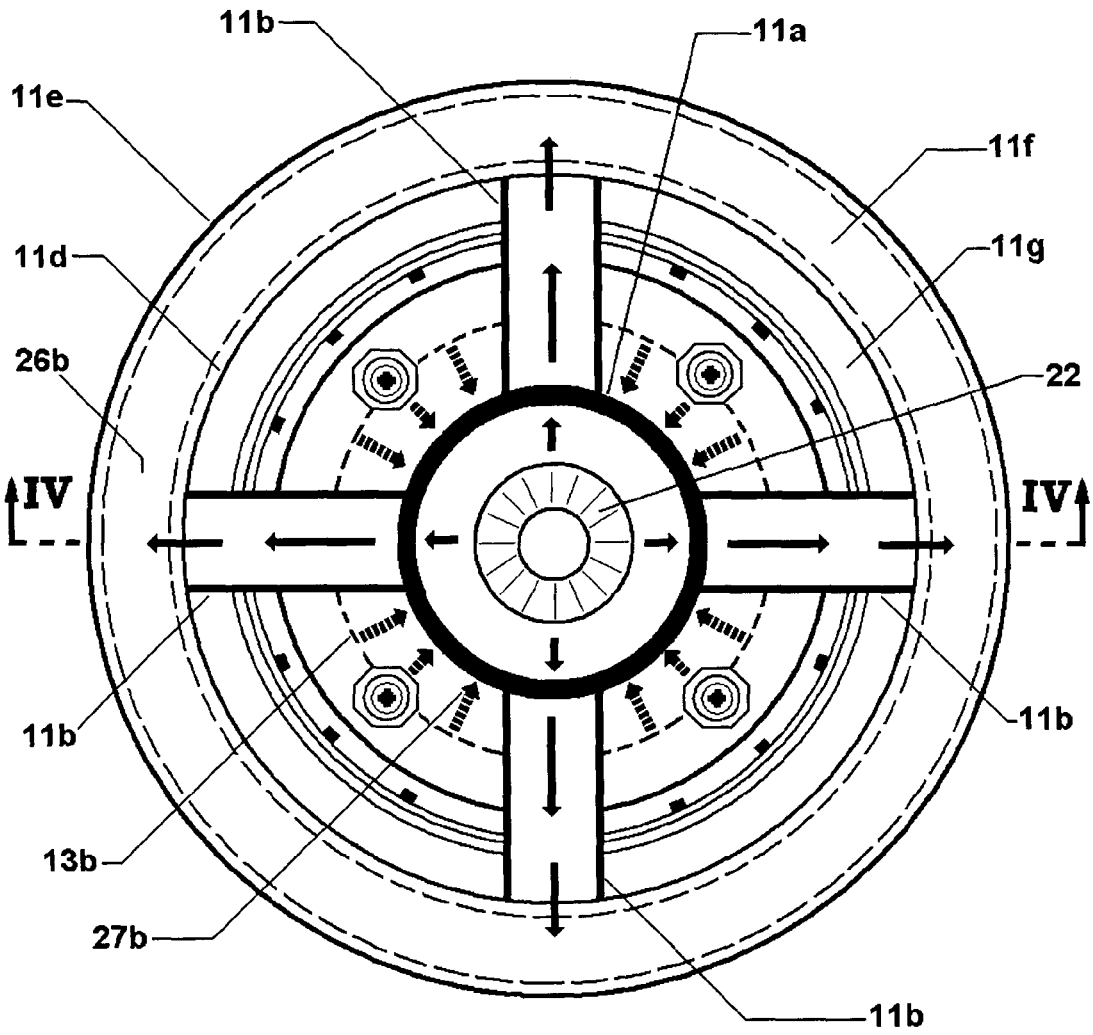
FIG. 5B presents the same modified form of the internal components already described in FIG. 5A, according to the plan or top I—I view indicated in such FIG. 5A. (arrows indicate internal air flows or discharge air jets).

FIG. 5A shows a side vertical or elevation sectional view (the plane upon which this sectional view is taken, is indicated as IV—IV in FIG. 5B) of an advanced modified form, with respect to FIG. 3A, for the distribution flow passages that feed the necessary quantity of said compressed ambient air mass flow 1*b* needed to create the aerodynamic flames containment mechanism as described in such FIGS. 3A and 4A.

In this FIG. 5A, with respect to the original form presented in FIG. 3A, the number of said horizontal ducts or pipes 11*b* is increased again to four, however, said vertical ducts or pipes 11*c* and said (individual) directional convergent nozzles 13*a*, are totally eliminated, and substituted by the modified components herein presented.

This modified configuration of four horizontal ducts or pipes 11*b*, allows again part of the compressed ambient air mass flow 1*b*, to be distributed or transported outwards from said distribution manifold header 11*a*. However, in this case, a new internal flow passage is formed between or in the middle of, the inner vertical cylinder 11*d* and the outer vertical cylinder 11*e*, incorporating the two plane circular sections closing ends 11*f* (top and bottom) to join the two cylinders and seal off the flow, conforming a new complete distribution flow passage 26*b* (four pipes and mid cylinders), by means of which, the necessary quantity of compressed ambient air mass flow 1*b*, is fed now, to the plane radial duct and flange 11*g* (attached to the inner cylinder), whereon is coupled the advanced "ring" or circumferential directional convergent nozzle 13*b*, which presents now a total discharge flow area, which creates, in this modified form, a uniform circumferentially distributed radial discharge air jet 27*b*, which flows radially inwards all around or symmetrically on said high speed ambient air jet containing water droplets 14*a*.

This modified form of said (individual) directional convergent nozzles 13*a*, as described in FIG. 3A and 4A, allows in this configuration, to create an advanced radial aerodynamic flames containment mechanism utilizing said "ring" directional convergent nozzle 13*b*, because it permits the creation now of said uniform circumferentially distributed radial discharge air jet 27*b* with no escape sections for runaway flame fronts and no orientation needs for the operator with respect to the direction of any axes of flames containment.

Said concentric vertical inner and outer cylinders 11*d* and 11*e* respectively, furthermore create now a solid cylindrical receptacle or chamber that improves said nozzles 12 and 22 internal flows' total thermal insulation from the hot external surroundings, including heat transfer from the strong flames' thermal radiation.

Aerodynamic interference mechanisms created among all these jet flows interactions, produce a highly turbulent resultant vertical air flow 27*c* within this solid inner vertical cylinder 11*d* chamber configuration, wherein natural convective flame flows can not be sustained, and therefore occur the flames' annihilation without producing in any direction the aforesaid scurrying or runaway flame fronts and circumferentially, canceling out the possibility of feeding with the necessary oxygen and make grow all around adjacent flame fronts of burning materials on solid surfaces (flames origins) when the distance of said jacketed convergent-divergent nozzle 22 discharge line is set to a minimum with respect to the physical flames' origin, or in other words, when the bottom of the cylinders is placed in direct physical contact with the solid surface during several seconds, operation that seals off or closes down the lower end of the chamber formed by said solid inner vertical cylinder 11*d*, and the only way out for the flow, is vertically upwards as this aforesaid vertical air flow 27*c* shows. Procedure used to suppress big intense flames utilizing the aforesaid pneumatic cylinder 18*a*.

FIG. 5B.

FIG. 5B presents the same internal components already described in FIG. 5A, according now to the plan or top I—I view indicated in FIGS. 1 and 2, and the corresponding one in such FIG. 5A.

In this FIG. 5B, again, four horizontal ducts or pipes 11*b* emerge from said distribution manifold header 11*a*, all of them merging with the inner side of said inner vertical cylinder 11*d*, conforming together with said outer vertical cylinder 11*e* and the plane circular sections closing ends 11*f*, the indicated flow passage 26*b*. According to this plan view, said "ring" or circumferential directional convergent nozzle 13*b* discharge line is shown only by a dashed circle line. Also, circumferentially distributed radial discharge air flow 27*b* is shown only by radial broken arrows.

For a better identification, not visible air flows and components, pertaining to this view, are indicated by broken arrows or phantom (dashed) lines, respectively.

FIG. 6.

Figure 6:
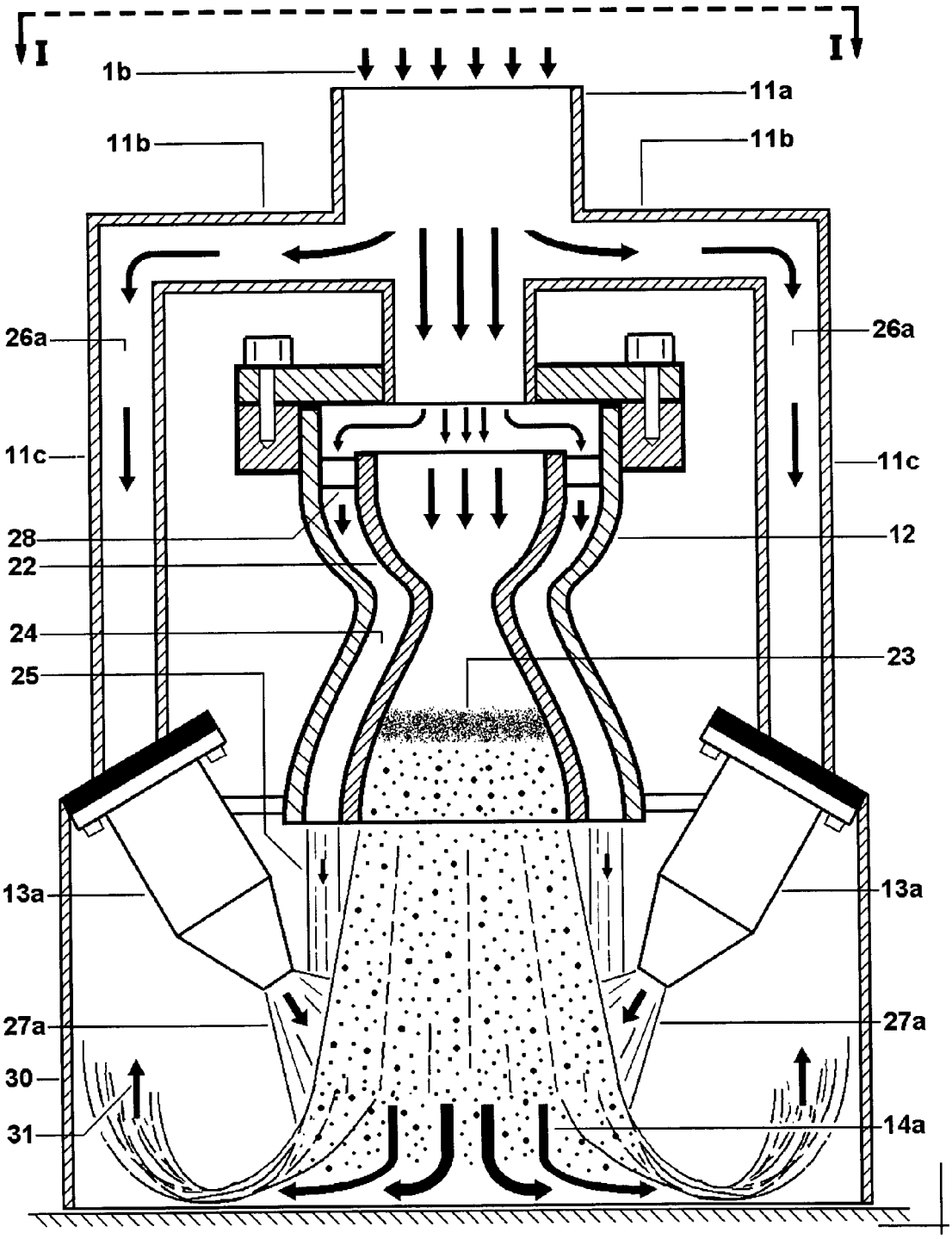
FIG. 6 describes a side vertical or elevation sectional view (the plane upon which this sectional view is taken, is indicated as II—II in FIG. 3B) of still another modified form of the internal components of this system where the aero-thermodynamic fire control process takes place, incorporating, with respect to FIG. 3A, one additional solid flame containment component for vertical forced flows flame suppression enhanced capability. (arrows indicate internal air flows or discharge air jets).

FIG. 6 shows a side vertical or elevation sectional view (the plane upon which this sectional view is taken, is indicated as II—II in FIG. 3B) of another modified form of this invention, wherein, with respect to the original form depicted in FIG. 3A, the solid "skirt" containment 30 (cylindrical for conical nozzles or rectangular for plane nozzles) is optionally installed in the system in high intensity, wind blowing fires situations, provoking the existence of additional recirculation vertical flows 31 generating an enhanced forced vertical-flow flame blown off action for the configuration shown (individual convergent directional nozzles 13*a*).

All these configurations or modified forms presented for the "blast-gun" and related accessories, depend on their physical proximity to the flames' origin (jets' impact point) to enforce the jets' flame penetration, blown off and aerodynamic flame containment mechanisms capabilities, with a required resultant flow in the vertical upward direction.

Convergent-divergent nozzles 12 or 22 shown in FIGS. 3A, 4A, and 6, can be geometrically, of the conical, or of the plane (rectangular) form (same sectional view shown), and therefore, any components mentioned in these figures can be circular or rectangular, or cylindrical or prism, depending on the geometrical configuration applied to the nozzles.

FIG. 7.

Figure 7:
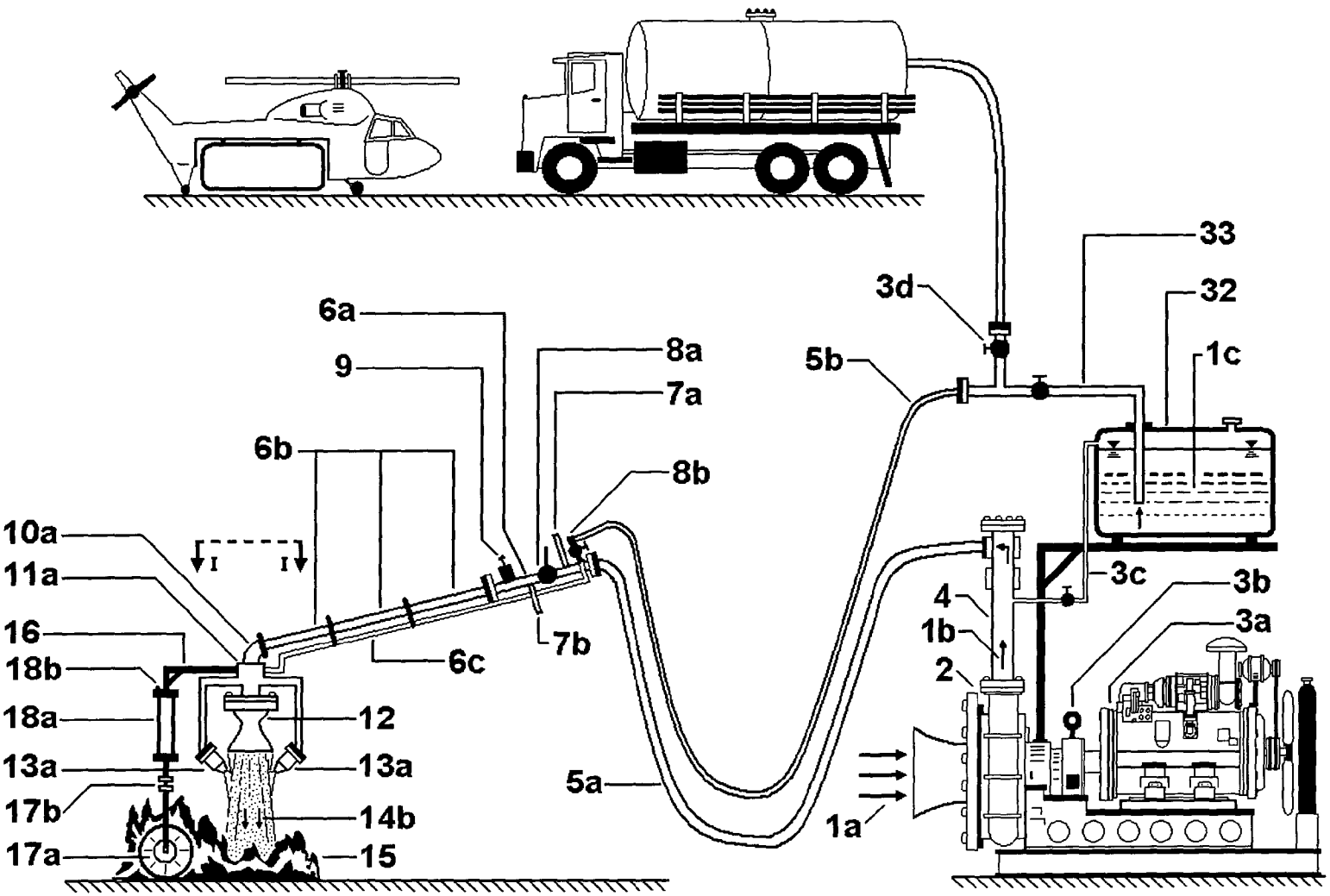
FIG. 7 corresponds to a side vertical or elevation overview of the complete flame suppressor system (corresponding to FIG. 1) already set up in a fire location as the operator (fire fighter) should manipulate it, but herein is presented a general modified form where the aspersion mechanism of this invention is utilized to deliver a liquid chemical fire fight agent to the flames site. (arrows indicate respective fluid flows).

FIG. 7 shows a side vertical or elevation overview of a fire fight scene or location where the ambient-air jet blast flames containment and suppression system of this invention is operating.

Herein is described a modified form of the complete fire fight system of this invention, wherein, its aspersion mechanisms are utilized to deliver a liquid (or foam) chemical agent to the flames site.

In this FIG. 7, the installation of deposit or tank 32, allows the storage of a liquid chemical fire fight agent 1*c* (including plain liquid water).

Air pressure line 3*c*, permits the pressurization of said tank 32, and therefore, said liquid chemical fire fight agent 1*c* can flow out through the liquid agent manifold 33.

External continuous supply or replenishment of said liquid chemical fire fight agent 1*c* in the fire location, can be accomplished by a suitable vehicle using supply valve 3*d*.

A mass flow of said liquid chemical fire fight agent 1*c*, is then transported to the flames site by the hose 5*b*, wherein is received by the agent control valve 8*b*, installed now on aforesaid control manipulator pipe 6*a*.

A controlled amount of said liquid chemical fire fight agent 1*c*, flows towards said distribution manifold header 11*a* through the appended pipe line 6*c*, been eventually fed internally to said jacketed convergent-divergent nozzle 22. (Internal details presented in FIGS. 10A and 10B).

Said jacketed convergent-divergent nozzle 22 internal air flow expansion permits the atomization of said liquid chemical fire fight agent 1*c*, and in this invention, a high speed ambient air jet containing water and liquid fire fight agent droplets 14*b*, accomplish the agent's aspersion on the flames 15 origin, with the added characteristic of a high flame front penetration capability.

FIG. 8.

Figure 8:
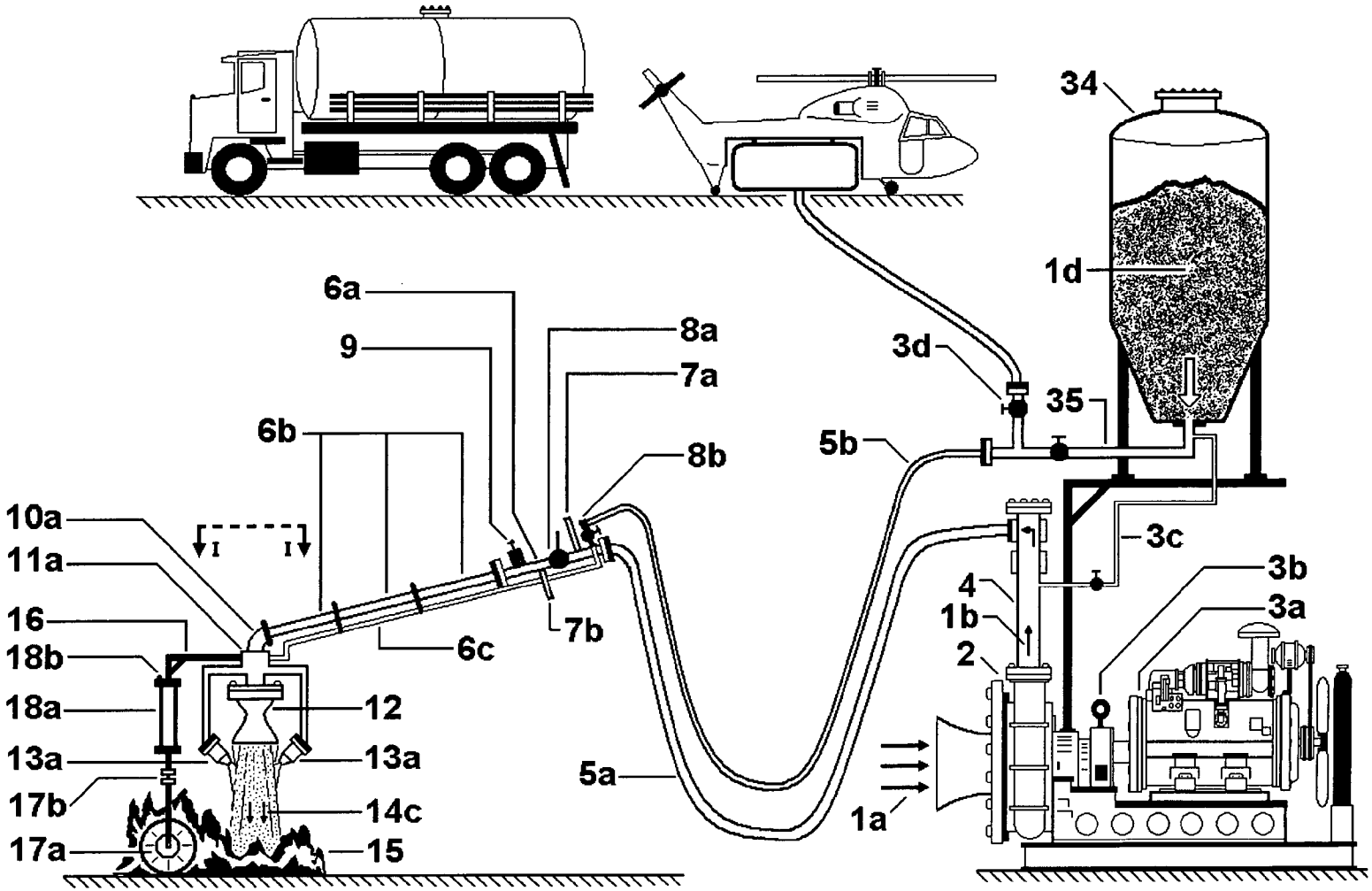
FIG. 8 corresponds to a side vertical or elevation overview of the complete flame suppressor system (corresponding to FIG. 1) already set up in a fire location as the operator (fire fighter) should manipulate it, but herein is presented a general modified form where the aspersion mechanism of this invention is utilized to deliver a solid (powder or granular) chemical fire fight agent to the flames site. (arrows indicate respective fluid and suspended solid particles flows).

FIG. 8 presents a modified form of the complete fire fight system of this invention, wherein, its aspersion mechanisms are utilized to deliver a solid (powder or granular) chemical agent to the flames site.

In this FIG. 8, the installation of silo 34, allows the storage of a solid (powder or granular) chemical fire fight agent 1*d*.

Air pressure line 3*c* permits, in this configuration, the necessary quantity of air flow to establish a pneumatic conveyor transport system, performing the fluidization of said solid chemical agent 1*d* particles in said silo 34, therefore been able to flow out, suspended in an air stream, through the solid agent manifold 35.

External continuous supply or replenishment of said solid chemical fire fight agent 1*d* in the fire location, can be accomplished by a suitable vehicle using supply valve 3*d*.

A mass flow of said solid chemical fire fight agent 1*d* particles, is then transported by said hose 5*b* to said control manipulator pipe 6*a*, which incorporates said agent control valve 8*b*.

A controlled amount of said solid chemical fire fight agent 1*d*, flows towards said distribution manifold header 11*a* through said appended pipe line 6*c*, been eventually fed internally to said jacketed convergent-divergent nozzle 22. (Internal details presented in FIGS. 10A and 10B).

Said jacketed convergent-divergent nozzle 22 internal air flow expansion permits an additional fluidization and acceleration of said solid chemical fire fight agent 1*d* particles, and in this modified form of this invention, a high speed ambient air jet containing water droplets and solid chemical agent particles 14*c*, accomplish the agent's aspersion on the flames 15 origin, with the added characteristic of a high flame front penetration capability.

FIG. 9.

Figure 9:
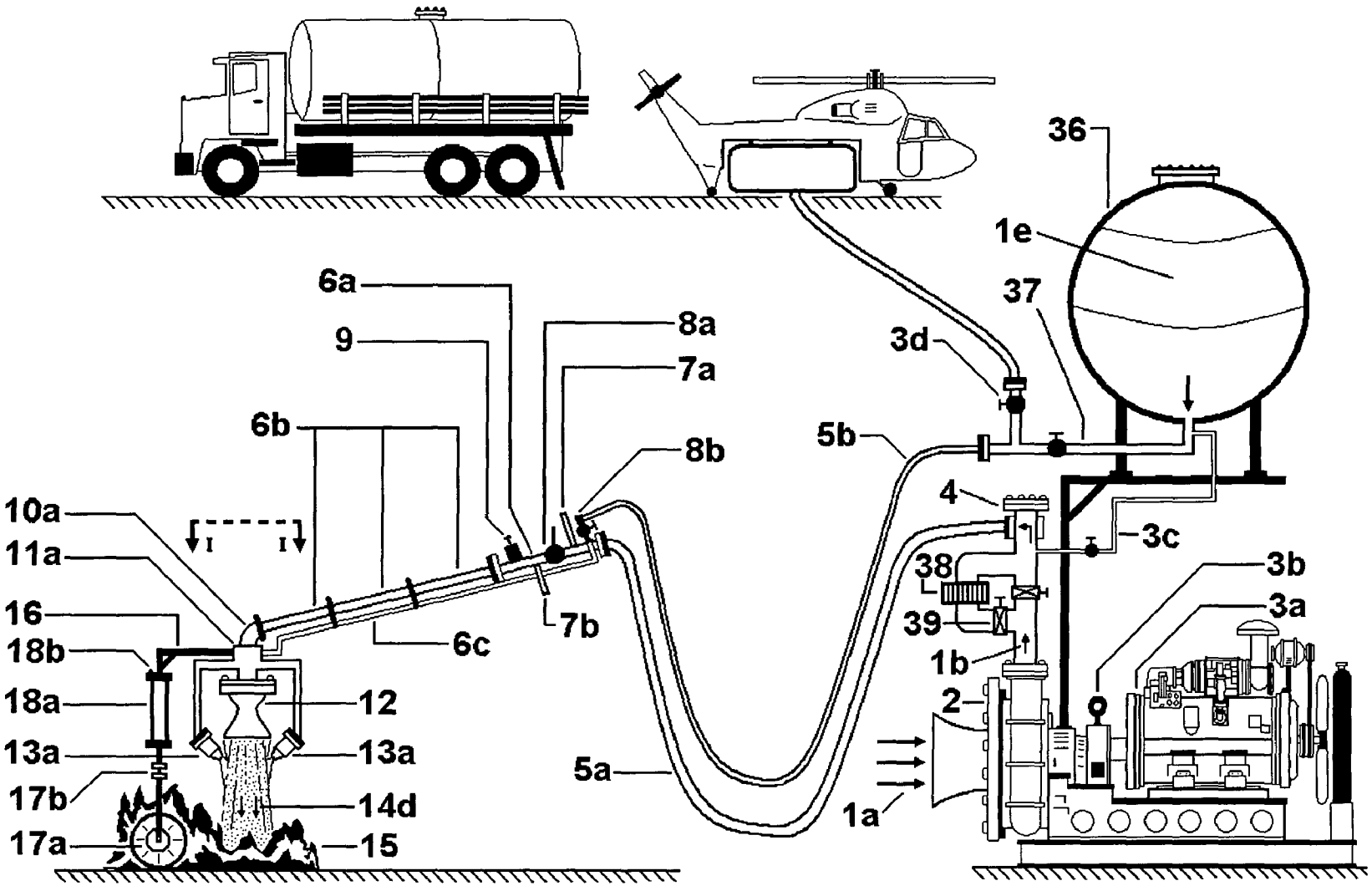
FIG. 9 corresponds to a side vertical or elevation overview of the complete flame suppressor system (corresponding to FIG. 1) already set up in a fire location as the operator (fire fighter) should manipulate it, but herein is presented a general modified form wherein the aspersion mechanism of this invention is utilized to deliver a gaseous chemical fire fight agent to the flames site. (arrows indicate respective fluid flows).

FIG. 9 presents a side vertical or elevation overview and describes another complete modified form of the fire fight system of this invention, wherein, its aspersion mechanisms are utilized to deliver now a gaseous chemical agent to the flames site.

In this FIG. 9, the installation of deposit or tank 36, allows the pressurized storage of a gaseous chemical fire fight agent 1*e*.

Air pressure line 3*c* permits optionally the additional pressurization of said tank 36, if the given gases mixture (including the air's water vapor) is allowed or recommended. Anyhow, as a gases mixture, or separately by its own pressure, said gaseous chemical fire fight agent 1*e* can flow out through the gaseous agent manifold 37.

External continuous supply or replenishment of said gaseous chemical fire fight agent 1*e* in the fire location, can be accomplished by a suitable vehicle using supply valve 3*d*.

A flow of said gaseous chemical fire fight agent 1*e*, is then transported by said hose 5*b* to said control manipulator pipe 6*a*, which incorporates said agent control valve 8*b*.

A controlled amount of said gaseous chemical fire fight agent 1*e*, flows towards said distribution manifold header 11*a* through said appended pipe line 6*c*, been eventually fed internally to said jacketed convergent-divergent nozzle 22. (Internal details presented in FIGS. 10A and 10B).

In this modified form, said hoses 5*a* and 5*b*, permit the independent transport (or shut off) of: said compressed ambient air mass flow 1*b*, controlled by the air control valve 8*a*, and said gaseous chemical fire fight agent 1*e* mass flow, controlled by the agent control valve 8*b*.

Said jacketed convergent-divergent nozzle 22 geometrical design, permits simultaneously (as a gases mixture) or individually, the internal, compressed ambient air mass flow 1*b* expansion (if any flow), and/or the internal gaseous chemical fire fight agent 1*e* mass flow expansion (if any flow), and in this invention, if the gases mixture is chemically allowed or beneficial, a high speed ambient air and gaseous chemical fire fight agent jet containing water droplets 14*d*, accomplish the agent's aspersion on the flames 15 origin, with the added characteristic of a high flame front penetration capability.

In this modified form, said exhaust manifold 4, incorporates a refrigeration unit or dehumidifier equipment 38, which can be activated with by-pass valve 39, eliminating, if chemically necessary, any water vapor contents in said compressed ambient air mass flow 1*b*.

FIG. 10A.

Figure 10A:
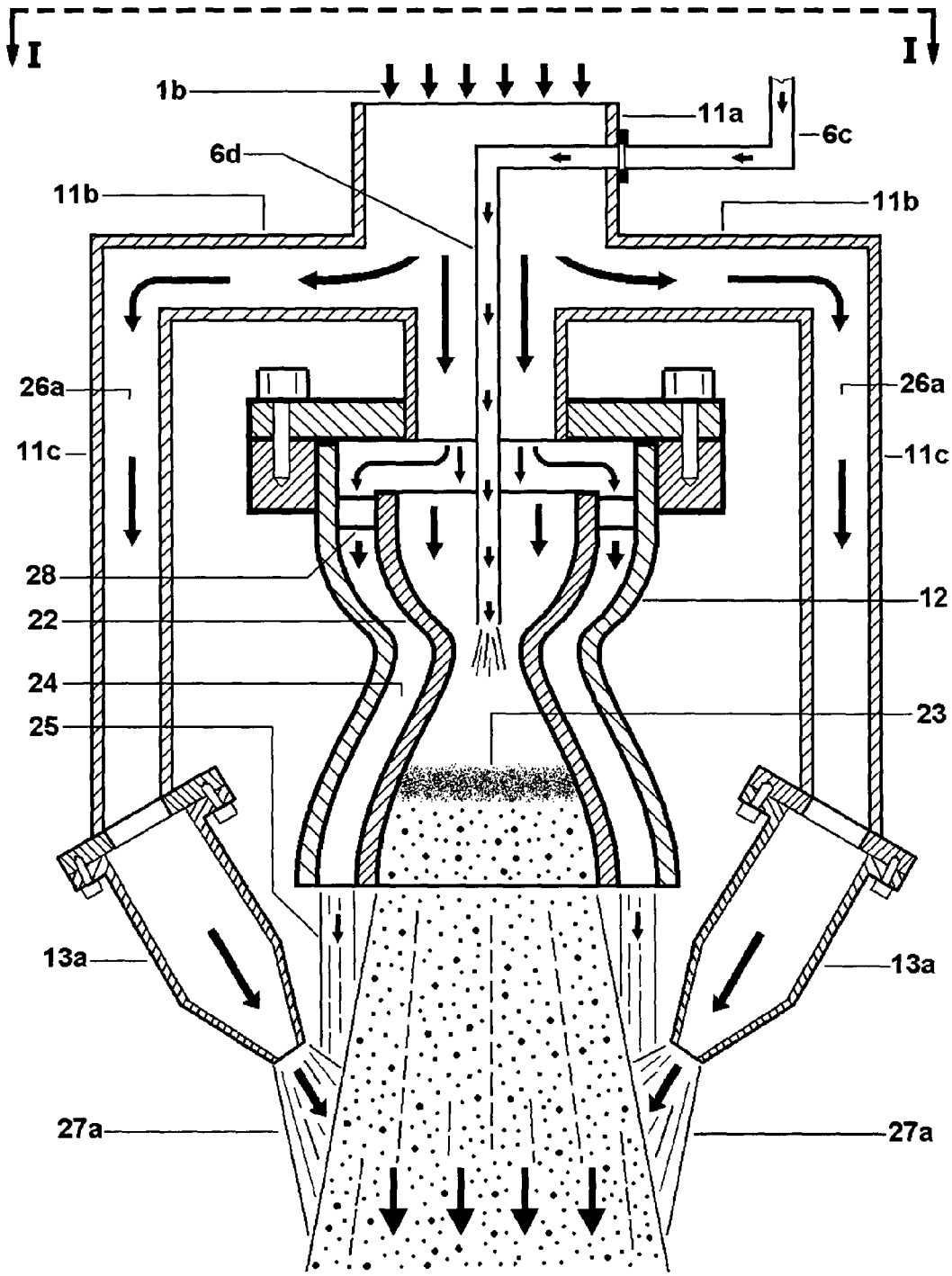
FIG. 10A describes a side vertical or elevation sectional view (the plane upon which this sectional view is taken, is indicated as V—V in FIG. 10B) of the internal components of this system where the aero-thermodynamic fire control process takes place, presenting herein the additional internal component needed to deliver the different chemical agents mentioned in FIGS. 7, 8 and 9 (same sectional view) to the flames site and to perform their aspersion. (arrows indicate respective flows).
Figure 10B:
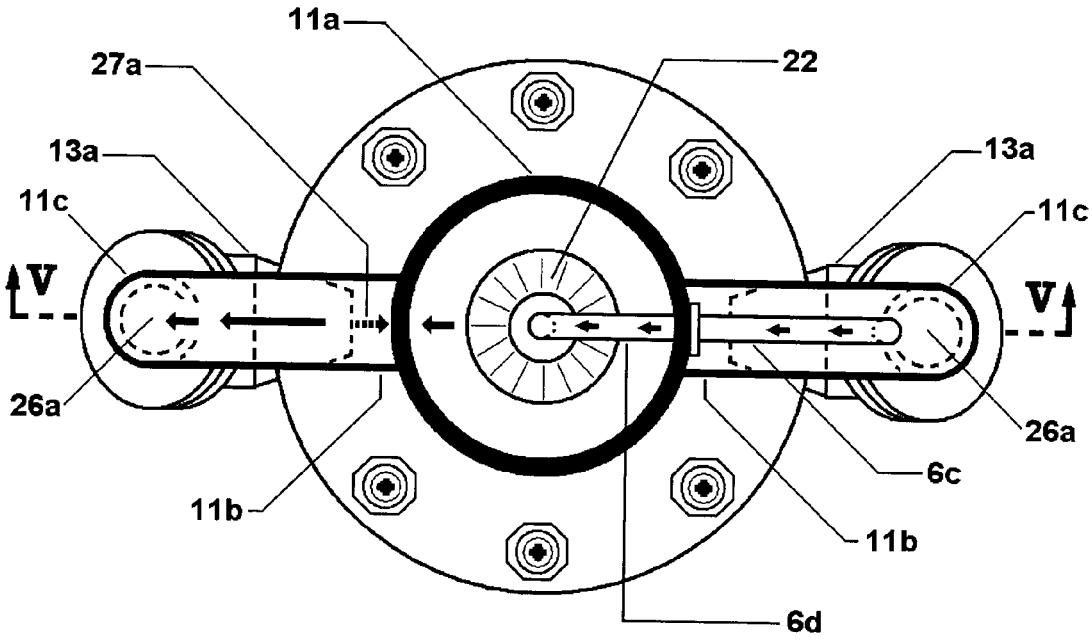
FIG. 10B presents the same internal components already described in FIG. 10A, according now to the plan or top I—I view indicated in FIGS. 7, 8 and 9, and in such FIG. 10A. (arrows indicate respective flows).

FIG. 10A describes a side vertical or elevation sectional view (the plane upon which this sectional view is taken, is indicated as V—V in FIG. 10B) of the internal components where the aero-thermodynamic flame suppression process and chemical agent aspersion take place.

In this FIG. 10A, said appended pipe line 6*c*, transporting the chemical agent, is attached or connected to said distribution manifold header 11*a*.

The chemical agent's internal transport continuation is performed by the injector pipe 6*d*, which releases the chemical agent inside said jacketed convergent-divergent nozzle 22, allowing the agent's aspersion.

FIG. 10B.

FIG. 10B presents the same internal components already described in FIG. 10A, according now to the plan or top I—I view indicated in such FIG. 10A.

Not visible air flows and components, pertaining to this view, are indicated by broken arrows or phantom (dashed) lines, respectively.

Since other modifications and changes effectuated to fit particular operating requirements and physical circumstances, will be apparent to those skilled in the art, those modifications and changes will be considered only as parts of an additional or subsequent technology development process applied to the original conceptual design pertaining to this same invention, which is not limited to the embodiments presented for purposes of disclosure, and covers all changes and modifications which do not constitute a departure from the true spirit and scope of the invention herein presented.

While various embodiments of the present invention have been described in detail, it is apparent that substitutions, modifications, adaptations and equivalents of those embodiments will occur to those skilled in the art.

However, it is to be expressly understood that any of such modifications and adaptations are within the true scope and definition of the present invention, as set forth in the appended claims.

The invention claimed is:

1. The method of extinguishing a fire by the flames containment and suppression process herein described which comprises the steps of:

A) compressing a continuous mass gas mixture of dry air and superheated water vapor in a fire location;

B) receiving an external fire-fighting agent of at least one of liquid, foam, powder, granular, or gaseous which is delivered to the fire location;

C) storing the external fire-fighting agent at the fire location;

D) supplying a continuous mass flow of the gas mixture of dry air and superheated water vapor to the flames site;

E) supplying a continuous mass flow of the external fire-fighting agent of at least one of liquid, foam, powder, granular, or gaseous to the flames site;

F) expanding in a jacketed or thermally insulated flow passage the continuous mass flow of the gas mixture of dry air and superheated water vapor, increasing the flow velocity, and thereby, generating a high flame-front penetration and blast capability, flames-suppression air jet, which is directed to the flames site disrupting said flames natural aerodynamics and blasting their origin, bringing about such flames blown off and combustion process extinction;

G) expanding in a horizontal or angled flow passage or passages the continuous mass flow of the gas mixture of dry air and superheated water vapor, increasing flow velocity, and thereby, generating a directional flame-containment air jet or jets, which are directed to the flames site, constraining run-away flames fronts from escaping, and preventing non burning surrounding materials inflammation;

H) expanding in a outer jacket or flow passage of the continuous mass flow of the gas mixture of dry air and superheated water vapor, increasing the flow velocity, and thereby, establishing a heat shield or thermal insulation air mass flow, in which the discharge air jet is directed to the flames site, preventing thereat, the heat transfer from the high temperature surrounding flames environment to the expanding continuous flow of ambient air in said jacketed flow passage and to the flames-suppression air jet;

I) expanding in the jacketed or thermally insulated flow passage, the continuous mass flow of the gas mixture of dry air and superheated water vapor, increasing the flow velocity, preventing the heat transfer from the high temperature surrounding flames environment, decreasing the flow temperature, and thereby, establishing a condensation shock wave, which produces water droplets from the superheated water vapor contents in said continuous compressed ambient air mass flow, generating thereat, a flames-suppression air jet with water droplets, which are directed to the flames site, wetting and cooling the inflammable materials, provoking further combustion inhibition;

J) feeding in the continuous mass flow of the gas mixture of dry air and superheated water vapor that expanding in the jacketed or thermally insulated flow passage, a continuous flow of the external liquid or foam fire-fighting agent, stored in a tank at the fire location and transported to the flames site by mean of a air pressurized tank discharge, and thereby, establishing its aspersion on the flames by means of said continuous mass flow of the gas mixture of dry air and superheated water vapor, generating thereat, a flames-suppression air jet with the external liquid or foam fire-fighting agent, which are directed to the flames site, extinguishing such flames;

K) feeding in the continuous mass flow of the gas mixture of dry air and superheated water vapor that expanding in the jacketed or thermally insulated flow passage, a continuous flow of an external powder or granular fire-fighting agent, stored at the fire location in a silo and transported to the flames site by means of a pneumatic conveyor discharge, and thereby, establishing its aspersion on the flames by means of said continuous mass flow of the gas mixture of dry air and superheated water vapor, generating thereat, a flames-suppression air jet with the external powder or granular fire-fighting agent, which are directed to the flames site, extinguishing such flames;

L) feeding in the continuous mass flow of the gas mixture of dry air and superheated water vapor expanding in the jacketed or thermally insulated flow passage, a continuous flow of an external gaseous fire-fighting agent, stored at the fire location in a tank and transported to the flames site by means of a dry air or gaseous agent pressurized tank discharge, and thereby, establishing its aspersion on the flames by means of said continuous mass flow of the gas mixture of dry air and superheated water vapor, generating thereat, a flames suppression air jet with the external gaseous fire-fighting agent, which are directed to the flames site, extinguishing such flames;

M) providing a compressor unit (2), a power drive (3*a*), a hook keeper (3*b*), a compressed air exhaust manifold (4), a compressed air hose (5*a*), a control manipulator pipe (6*a*), extension pipes (6*b*), a handle (7*a*), a handle (7*b*), suspenders (7*c*), a air throttle valve (8*a*), and, a rotary elbow (10*a*), to supply the continuous mass flow of the gas mixture of dry air and superheated water vapor to the flames site;

N) providing a external fire-fighting agent supply valve (3*d*), to receive the external fire-fighting agent of at least one of liquid, foam, powder, granular, or gaseous delivered to the fire location;

O) providing an external liquid or foam fire-fighting agent tank (32), to store at the fire location, and delivering the liquid or foam external fire-fighting agent;

P) providing an external powder or granular fire-fighting agent silo (34), to store at the fire location, and delivering the powder or granular external fire-fighting agent;

Q) providing an external gaseous fire-fighting agent tank (36), to store at the fire location, and delivering the gaseous external fire-fighting agent;

R) providing a tank pressurization air pressure line (3*c*), and a liquid or foam external fire-fighting agent manifold (33), to transport the continuous mass flow of an liquid or foam external fire-fighting agent (1*c*) from the fire location to the flames site;

S) providing a solid-fluidization air pressure line (3*c*), and a powder or granular external fire-fighting agent manifold (35), to transport the continuous mass flow of the powder or granular external fire-fighting agent (1*d*) from the fire location to the flames site;

T) providing a tank pressurization dry air pressure line (3*c*), a gaseous external fire-fighting agent manifold (37), a dehumidifier (38), and a by-pass valve (39), to transport the continuous mass flow of the gaseous external fire-fighting agent (1*e*) from the fire location to the flames site;

U) providing an external fire-fighting agent hose (5*b*), an external fire-fighting agent control valve (8*b*), and an external fire-fighting agent appended pipe line (6*c*), to supply the external fire-fighting agent of at least one of liquid, foam, powder, granular, or gaseous continuous mass flow to the flames site;

V) providing a distribution manifold (11*a*), to install the flow passages and pads of a "blast-gun" where into, the continuous mass flows of the gas mixture of dry air and superheated water vapor are distributed and expanded;

W) providing an outer convergent-divergent nozzle (12), supports or struts (28), and a jacketed convergent-divergent nozzle (22), to expand the continuous mass flow of the gas mixture of dry air and superheated water vapor generating the flames-suppression air jet with water droplets (14*a*), and the continuous mass flow of the gas mixture of dry air and superheated water vapor generating a thermal-insulation air flow and discharge air jet (25);

X) providing an outer straight duct (29), supports or struts (28), and the jacketed convergent-divergent nozzle (22), to expand the continuous mass flow of the gas mixture of dry air and superheated water vapor generating the flames-suppression air jet with water droplets (14*a*), and the continuous mass flow of the gas mixture of dry air and superheated water vapor generating the thermal-insulation air flow and discharge air jet (25);

Y) providing a injector pipe (6*d*), to feed the continuous mass flow of the external fire-fighting agent of at least one of liquid, foam, powder, granular, or gaseous in the continuous mass flow of expanding gas mixture of dry air and superheated water vapor, generating the flames-suppression air jet with the fire-fighting agent accomplishing its aspersion;

Z) providing two horizontal ducts or pipes (11*b*), two vertical ducts or pipes (11*c*), and two directional convergent nozzle: (13*a*), to expand the continuous mass flow of the a gas mixture of dry air and superheated water vapor, generating two flame-containment air jets (27*a*);

AA) providing four horizontal ducts or pipes (11*b*), four vertical ducts or pipes (11*c*), and four directional convergent nozzles (13*a*), to expand a continuous mass flow of the gas mixture of dry air and superheated water vapor, generating four flame-containment air jets (27*a*);

BB) providing an inner vertical cylinder (11*d*), an outer vertical cylinder (11*e*), two closing ends (11*f*), a radial duct and flange (11*g*), and a circumferential directional convergent nozzle (13*b*), to expand a continuous mass flow of the gas mixture of dry air and superheated water vapor, generating a radial discharge flame-containment air jet (27*b*);

CC) providing a solid "skid" containment (30), to provoke the existence of air recirculation vertical flows (31), generating an enhanced forced vertical-flow flames blown off action;

DD) providing a pneumatic control (9), a support (16), a wheel (17*a*), a vertical rotation attachment (17*b*), a pneumatic cylinder (18*a*), and, a connection point (18*b*), to direct the flames-suppression air jet, water droplets, flame-containment air jets, the thermal-insulation discharge air jet, and the external fire-fighting agent of at least one of liquid, foam, powder, granular, or gaseous, to the flames site, performing efficiently the fire fighting work activities to extinguishing such flames; and EE) providing a elbow accessory (11*b*), a pole support (19), a pivoted anchor (20), a double-action pivoted anchor (21*a*), a ratchet wheel pivot (21*b*), a release pedal (21*c*), a platform (21*d*), and, a vertical rotation attachment (21*e*), to direct, a flames-suppression air jet, water droplets, flame-containment air jets, a thermal-insulation discharge air jet, and the external fire-fighting agent of at least one of liquid, foam, powder, granular, or gaseous, to the flames site, performing efficiently the fire fighting work activities to extinguishing such flames.

* * * * *